US005853850A

United States Patent [19]

Iwai et al.

[11] Patent Number: 5,853,850

[45] Date of Patent: Dec. 29, 1998

[54] LUBRICANT FILM COATED STEEL SHEET WITH EXCELLENT PHOSPHATABILITY AND METHOD FOR PRODUCING SAME

[75] Inventors: Masatoshi Iwai; Hiroaki Nakano, both of Kakogawa, Japan

[73] Assignee: Kabushiki Kaisha Kobe Seiko Sho, Kobe, Japan

[21] Appl. No.: 745,923

[22] Filed: Nov. 8, 1996

[30] Foreign Application Priority Data

| | | | |
|---|---|---|---|
| Nov. 13, 1995 | [JP] | Japan | 7-294555 |
| Feb. 23, 1996 | [JP] | Japan | 8-036711 |
| Jul. 16, 1996 | [JP] | Japan | 8-186231 |

[51] Int. Cl.[6] ..... B32B 3/00; B32B 9/00; B05D 3/02

[52] U.S. Cl. ..... 428/148; 428/145; 428/149; 428/172; 428/219; 428/469; 428/471; 428/640; 428/659; 428/702; 427/376.2; 427/419.2

[58] Field of Search ..... 422/154, 172, 422/141, 702, 471, 148; 428/145, 149, 219, 469, 640, 659; 427/287, 372.2, 376.2, 376.4, 419.2

[56] References Cited

U.S. PATENT DOCUMENTS 5,093,180 3/1992 Morgan ..... 428/156

*Primary Examiner*—Donald Loney
*Attorney, Agent, or Firm*—Oblon, Spivak, McClelland, Maier & Neustadt, P.C.

[57] ABSTRACT

A lubricant film coated steel sheet having excellent phosphatability, in accordance with the present invention, is a lubricant film coated steel sheet produced by forming a coating containing silicic acid or silicate on a steel sheet or a plated steel sheet, wherein the surface roughness of the steel sheet or the plated steel sheet is 0.5 to 1.5 $\mu$m as the centerline-average roughness RA and the PPI (cut-off value of 1.25 $\mu$m) thereof is 75 to 300; and the content of silicic acid or silicate in the coating is 1 to 200 mg/m$^2$ as corrected into dried $SiO_2$ weight or the coating ratio of the coating is 1 to 60%.

16 Claims, 13 Drawing Sheets

LUBRICANT FILM COATED STEEL SHEET WITH EXCELLENT PHOSPHATABILITY AND METHOD FOR PRODUCING SAME

BACKGROUND OF THE INVENTION

The present invention relates to a lubricant film coated steel sheet with excellent phosphatability and a method for producing the same.

Surface-treated steel sheet produced by treating the surface of a steel sheet with plating has been increasingly used in recent years; among them, zinc or zinc alloy coated steel sheet is frequently used, for example as surface-treated steel sheet for automobiles, because the zinc or zinc alloy coated steel sheet has excellent corrosion resistance. However, scratch occurs between the deposit and a dice at severely processed portions during press molding, disadvantageously. One of the causes of such scratch resides in the larger sliding deformation resistance applied to the plated surface layer due to press molding.

For the purpose of decreasing the sliding deformation resistance on the plated surface layer thereby increasing the sliding property, thus, a plated steel sheet has been developed, with a hard oxide film formed on the surface of the plated steel sheet to improve the lubricating property during press molding. For example, Japanese Patent Laid-open No. Sho 62-192597 discloses a plated steel sheet produced by imparting a hard layer of electrodeposited Fe-Zn alloy to a galvannealed steel sheet, wherein a technique is disclosed, comprising smoothing the recesses and protrusions on the plated surface of the underlining layer through the smoothing action involved in the formation of the plated layer, thereby improving the powdering characteristic. Furthermore, Japanese Patent Publication No. Hei 7-13306 discloses a technique of improving lubricating property, comprising imparting an anhydrous alkali metal salt of an oxide of semi-metal such as B, P, Si, and the like, to zinc deposit. Still furthermore, Japanese Patent Lad-Open No. Hei 6-116746 describes a technique of improving press formability, comprising forming a metal oxide in an island shape or a mosaic shape on zinc deposit. Additionally, Japanese Patent Publication No. Hei 7-13308 describes a galvanized steel sheet with a film containing Zn oxide, Mn oxide and one or more oxides of P, Mo, W and V on the surface thereof. Even by these methods, however, not any sufficient effect of improving the lubricating property to satisfy the demands required from manufacturers has been procured yet, and the production cost has been escalated therefore, disadvantageously.

Furthermore, Japanese Patent Laid-open No. Hei 1-136952 discloses a method to decrease the frictional coefficient between the surface of the plated layer and a dice, comprising coating a lubricating agent on the surface of the plated layer at a specified Fe concentration. Although such plated steel sheet containing a lubricating agent surely contributes to the improvement of lubricating action, phosphate coating is difficult to be formed during phosphatization, inconveniently, because the lubricating agent cannot be removed even at degreasing process prior to phosphatization process conducted by automobile manufacturers. The problem concerning the phosphatability is also remarked when a hard oxide coating is formed on the surface of a plated steel sheet. Therefore, the adhesion property of the coating is deteriorated, which is one factor to deteriorate the corrosion resistance after coating.

Japanese Patent Laid-open Nos. Sho 55-110783 and Sho 60-63394 disclose a plated steel sheet deposited with $SiO_2$ on the galvanized layer thereof, so as to improve the spot weldability of the plated steel sheet, because the adhesion process after automobile pressing is mainly carried out by spot welding.

The process of manufacturing automobiles includes not only spot welding process but also adhesion process of parts with adhesives after press molding, but it has been demonstrated that the adhesion property with adhesives is distinctively deteriorated when the oxide coating described above is coated onto the surface of the plated steel sheet. More specifically, the hems of for example door, food, and luggage adhere together with adhesives while oils are deposited on the hems. As such adhesives, use is made of vinyl chloride- and epoxy adhesives, and steel sheets adhere to each other after adhesive coating and baking. If the adhesion property between an adhesive and the steel sheet is poor, peeling occurs in the interface between the adhesive and the steel sheet to severely decrease the strength of the adhering part, disadvantageously.

SUMMARY OF THE INVENTION

The present invention has been achieved in such circumstance. The object of the present invention is to provide a lubricant film coated steel sheet with improved lubricating property to procure good press moldability and wit excellent phosphatability. An additional object of the present invention is to provide a lubricant film coated steel sheet having excellent adhesion with adhesive in oil, in addition to the lubricating property and phosphatability described above. A still other object of the present invention is to provide a method effective for manufacturing a lubricant film coated steel sheet having excellent lubricating property, phosphatability and adhesion with adhesive in oil.

The lubricant film coated steel sheet having excellent phosphatability in accordance with the present invention, which has overcome the problems described above, is a lubricant film coated steel sheet produced by forming a coating containing silicic acid or silicate on a steel sheet or a plated steel sheet, having micro-fine recesses and protrusions on the surface thereof, wherein the surface roughness of the steel sheet or the plated steel sheet is 0.5 to 1.5 $\mu$m as the centerline-average roughness RA, and the PPI (cut-off value of 1.25 $\mu$m) thereof is 75 to 300; and the content of silicic acid or silicate in the coating is 1 to 200 mg/m$^2$ as corrected into dried $SiO_2$ weight or the coating ratio of the coating is 1 to 60%. A type of silicate, preferably $Na_2O{\cdot}nSiO_2$, $K_2O{\cdot}nSiO_2$, or $Li_2O{\cdot}nSiO_2$ ("n" is an integer of 3 or more), is preferably used in accordance with the present invention. For the purpose of further improving the lubricating property of the steel sheet of the present invention, preferably, the coating preferably contains for example a wax particle of dispersing type in water or oxides of one or more elements selected from the group consisting of Zn, Ni, Co, Fe, P, B, Ca, Mo, W and V to a final total sum of the weights of these elements at 1 to 100 mg/m$^2$; otherwise, the coating is preferably coated with an oil of a viscosity of 5 to 50 mm$^2$/s at 40° C.

So as to further impart the effect of improving adhesion with adhesive in oil to the lubricant film coated steel sheet, B/A should be controlled above 1.2, provided that A and B are designated as the $SiO_2$ coating weight at the protrusion parts of the surface of the lubricant film coated steel sheet and the $SiO_2$ coating weight at the recess parts thereof. So as to procure more excellent adhesion with adhesive in oil, it is recommended for example to suppress the total sum of $Na_2O$, $K_2O$, and $Li_2O$ contained in the coating to 3% by weight of the $SiO_2$ in the coating.

It is recommended that the plated steel sheet described above is preferably a galvanized steel sheet, more preferably a galvannealed steel sheet at an Fe content of 7 to 15%, so as to procure more excellent lubricating property.

Furthermore, the method for producing a lubricant film coated steel sheet having excellent adhesion with adhesive in oil and fine phosphatability and capable of overcoming the problems, characteristically comprises coating a liquid at an $SiO_2$ content of not less than 0.1 g/liter in water and a $(Na_2O+Li_2O+K_2O)/SiO_2$ weight ratio of 3% by weight or less (inclusive of 0%) on the surface of a steel sheet or a galvanized steel sheet prior to drying, thereby forming a coating containing silicic acid or silicate on the surface of the steel sheet or the galvanized steel sheet.

From the respect of procuring good lubricating property by sufficiently removing water in the coating in accordance with the present invention, the heating temperature during drying should preferably be 80° C. or more. The $SiO_2$ in the solution to be used in accordance with the present invention, is preferably of a spherical particle of a particle size of 20 to 300 nm or a rod-like particle of a size (D) of 1 to 50 nm and a length (T) of 20 to 300 nm, provided that D<T. The latter rod-like particle is more preferably used. The method is the most useful for galvanized steel sheets.

DETAILED DESCRIPTION OF THE PREFERRED EMBODIMENTS

Figure 1:
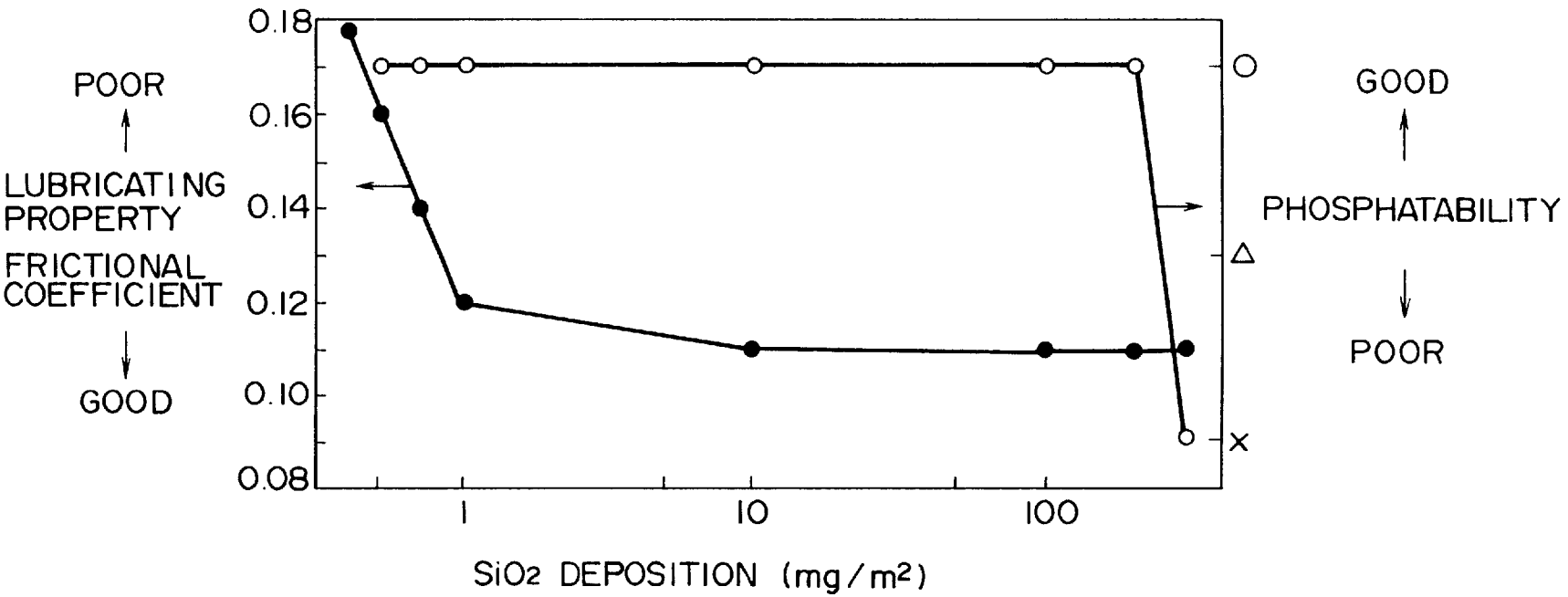
FIG. 1 depicts graphs representing the relation between $SiO_2$ deposition and lubricating property and phosphatability.

The present inventors have made intensive investigations about a method for improving the lubricating property of a steel sheet or a plated steel sheet with no deterioration of the phosphatability thereof. The inventors have found that the initial object can be attained by coating silicic acid or silicate [sometimes referred to as "silicic acid (silicate)" hereinbelow] on the surface of a steel sheet or a plated steel sheet (sometimes referred to as "steel sheet" hereinbelow), while controlling the surface roughness of the plated steel sheet within a specific range. Thus, the present invention has been achieved.

In accordance with the present invention, the term "PPI" means the total number of peaks of a size above 1.25 $\mu$m per 1-cm length. Designating the value 1.25 $\mu$m as cut-off value or peak count level, the PPI value absolutely increases if the cut-off value is set at a lower level. In accordance with the present invention, however, the most common cut-off value, namely 1.25 $\mu$m, is adopted in terms of simple measurement and reproducibility.

Explanation will follow about the silicic acid (silicate) coating coated on the surface of a steel sheet.

The coating is a strong, hard coating comprising microfine silica particles, and by forming such coating, the sliding deformation resistance to be loaded on the plated surface layer can be decreased during press molding. Additionally because silicic acid(silicate) is not costly, the production cost is advantageously down.

The silicate to be used in accordance with the present invention is a salt composed of silicon dioxide and a metal oxide and represented by a general formula $xM2O \cdot ySiO_2$, satisfactorily, preferably sodium silicate represented by $Na_2O \cdot nSiO_2$ ("n" is an integer), potassium silicate represented by $K_2O \cdot nSiO_2$, and lithium silicate represented by $Li_2O \cdot nSiO_2$. Herein, "n" is preferably within a range of 3 or more. If "n" is below 3, the phosphatability is deteriorated, while the hygroscopicity is further elevated to deteriorate the wet adhesion of paint after coating. As the value of "n" increases, the performance such as lubricating property is improved; an infinite increase of "n" corresponds to silicic acid.

So as to effectively exert the coating action of such silicic acid (silicate) contained in the coating, the content thereof in the coating is necessarily 1 to 200 mg/m$^2$ as corrected into the weight of dried $SiO_2$ (simply abbreviated as "$SiO_2$" sometimes) or the coating ratio of the coating is required to be 1 to 60%. The reasons why these values are thus determined are described with reference to FIGS. 1 and 2. Using a galvannelaed steel sheet as a representative example of the steel sheet of the present invention, examination has been made. The results are shown below. However, the reasons are not only applicable to the aforementioned steel sheet in a limited fashion but also applicable to hot-dip galvanized steel sheet, electrogalvanized steel sheet, steel sheet electrodeposited with Fe-Zn alloy, steel sheet electrodeposited with Zn-Ni alloy, and other steel sheets plated with other zinc alloy, in addition to Al plating, Pb plating, Sn plating and the like.

FIG. 1 depicts the examination results of the relation between $SiO_2$ deposition and lubricating property and phosphatability, when $Na_2O \cdot 5SiO_2$ is coated on a galvannealed steel sheet (the surface roughness of the galvanized steel sheet is Ra 1.0 μm and PPI 150.) Frictional coefficient is used as the indicator of the lubricating property; and the potency of conversion treatment is represented by phosphatability.

Frictional coefficient was measured by flat sliding test as shown below.

Sample size; 40×300 mm.
Tool; flat tool (18×20 mm).
Pressure loaded; 5 kg/mm$^2$.
Sliding velocity; 300 mm/min.
Sliding length; 150 mm.
Coating oil; Noxrust 550 (manufactured by Parker Industry); 2 g/m$^2$.

Specifically, by measuring the draw load, the frictional coefficient was calculated from the area pressure and the draw load.

Furthermore, phosphatability was assessed by the following method.

Phosphatizing solution; SD 5,000 (manufactured by Nippon Paint).
Process; degreasing→washing in water→surface adjustment→phosphatization.
Determination of phosphate coating;
under SEM observation, coating was grouped according to the following assessment standard;
○; uniform coating formed;
Δ; coating partially formed;
×; no coating formed.

As apparently shown in FIG. 1, the frictional coefficient is markedly decreased at $SiO_2$ of 1 mg/m$^2$ or more, which improves the lubricating property. However, the lubricating property is excellent above 200 mg/m$^2$ $SiO_2$ while the phosphatability markedly is deteriorated. Thus, the upper limit is defined as 200 mg/m$^2$. The lower limit is preferably 10 mg/m$^2$, more preferably 20 mg/m$^2$. Alternatively, the upper limit is preferably 100 mg/m$^2$, more preferably 60 mg/m$^2$.

In accordance with the present invention, thus, the $SiO_2$ content should necessarily be within the range described above so as to form the silicate containing coating; otherwise, by controlling the coating ratio of the coating, the initial object can be attained.

Strictly, the surface of a galvannelaed steel sheet has a form with fine protrusions and recesses, and therefore, silicate is generally deposited to the recess parts. The tendency is marked at a lesser amount of coating, in particular. No deposition is likely to be observed at the protrusion parts. The present inventors have made investigations and found out that silicate is not necessarily coated on the whole galvanized steel sheet. In the presence of a trace amount of the silicate at the recess parts, for example, the lubricating property of the galvanized steel sheet is distinctively improved. More specifically, the relation between the coating state of a coating and the lubricating property of the plated steel sheet has been examined in detail. It has been found that the lubricating property improves, on a dependent manner to the coating ratio of the coating in addition to silicate deposition.

Figure 2:
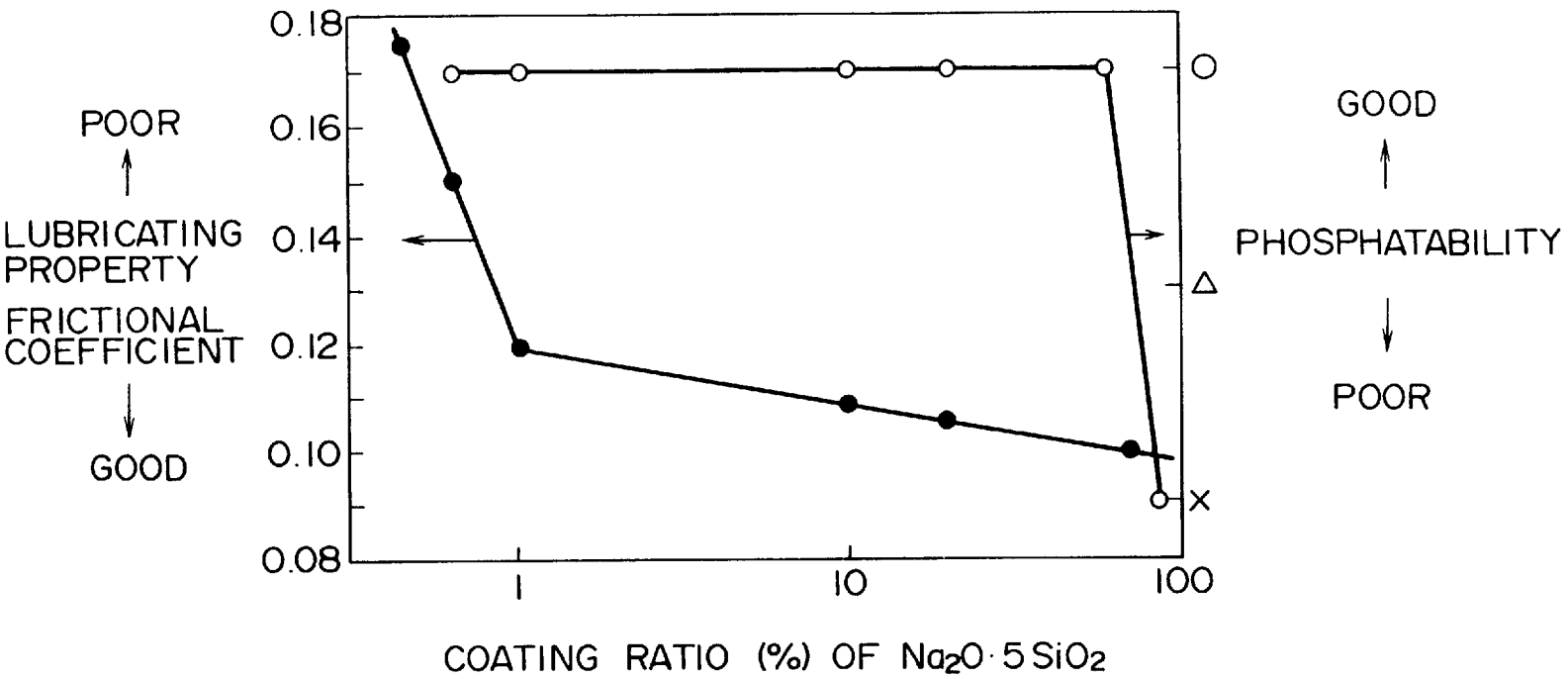
FIG. 2 depicts graphs depicting the relation between the coating ratio of a sodium silicate containing coating and lubricating property and phosphatability.

FIG. 2 depicts the relation between the coating ratio of a coating containing $Na_2O{\cdot}5SiO_2$ and the lubricating property and phosphatability, when $Na_2O{\cdot}5SiO_2$ is coated on a galvannealed steel sheet. The experimental conditions were substantially the same as the conditions bringing about the results of FIG. 1. The lubricating property and phosphatability were evaluated in the same manner. The term "coating ratio" means the area ratio of silicate coating the surface of a galvannealed steel sheet; more specifically, the area ratio was measured by observing the surface of a sample by EPMA, identifying the Si-concentrated part on an Si-specific X ray spectrum as the silicate coated part, and measuring the area by an image analyzer. The coating ratio is represented by [silicate coated area/area of measured sample].

As apparently shown in FIG. 2, the lubricating property is markedly improved above 1% of the coating ratio of the coating containing $Na_2O{\cdot}5SiO_2$. Because the phosphatability is severely deteriorated above 60% of the coating ratio, however, the upper limit is required to be 60%. The lower limit is preferably 10%, more preferably 20%; alternatively, the upper limit is preferably 50%, more preferably 40%.

In accordance with the present invention, it is intended that lubricating property is far greatly improved by defining the surface roughness of a galvanized steel sheet as Ra of 0.5 to 1.5 μm and PPI of 75 to 300. The reasons why these numerical figures are determined are described below with reference to FIGS. 3 and 4.

Figure 3:
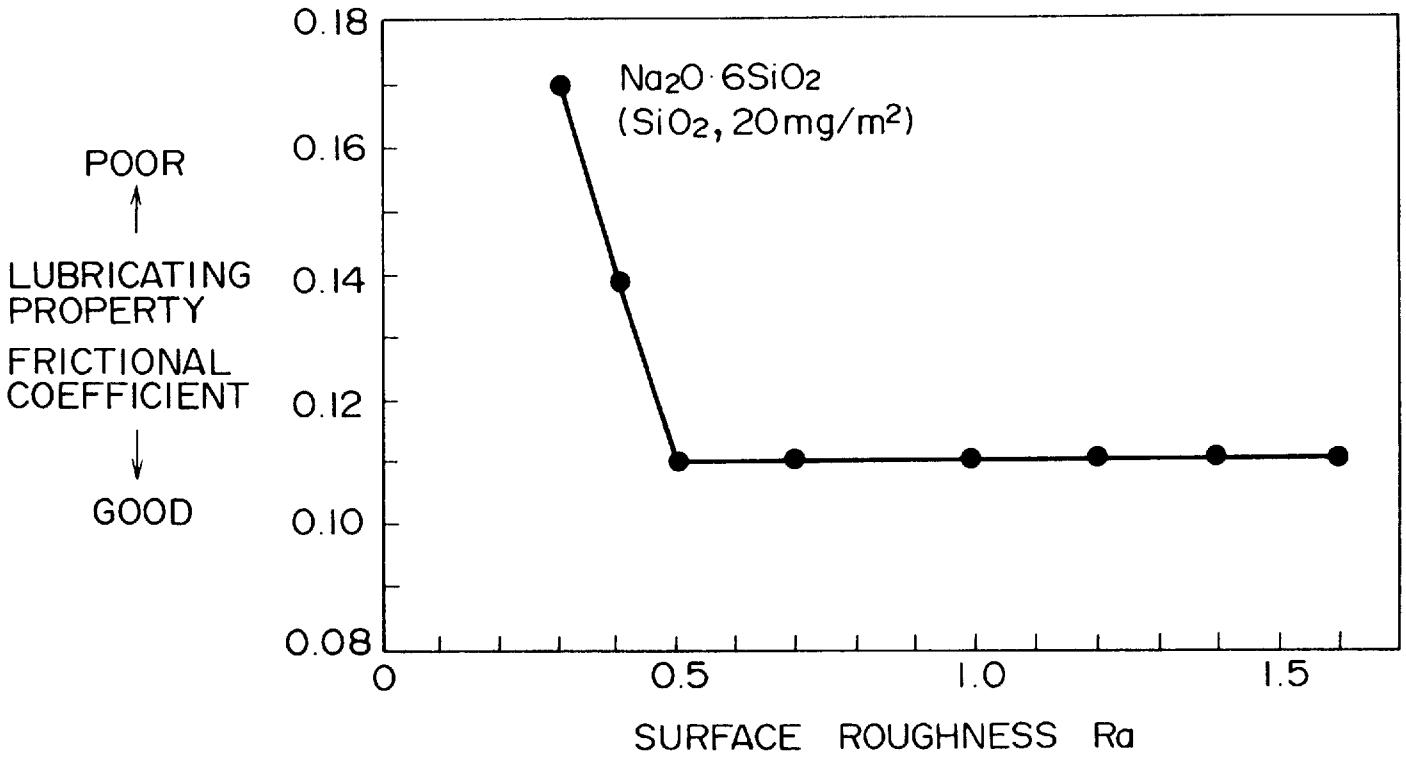
FIG. 3 depicts a graph representing the relation between the surface roughness Ra of a galvannelaed steel sheet and the lubricating property.
Figure 4:
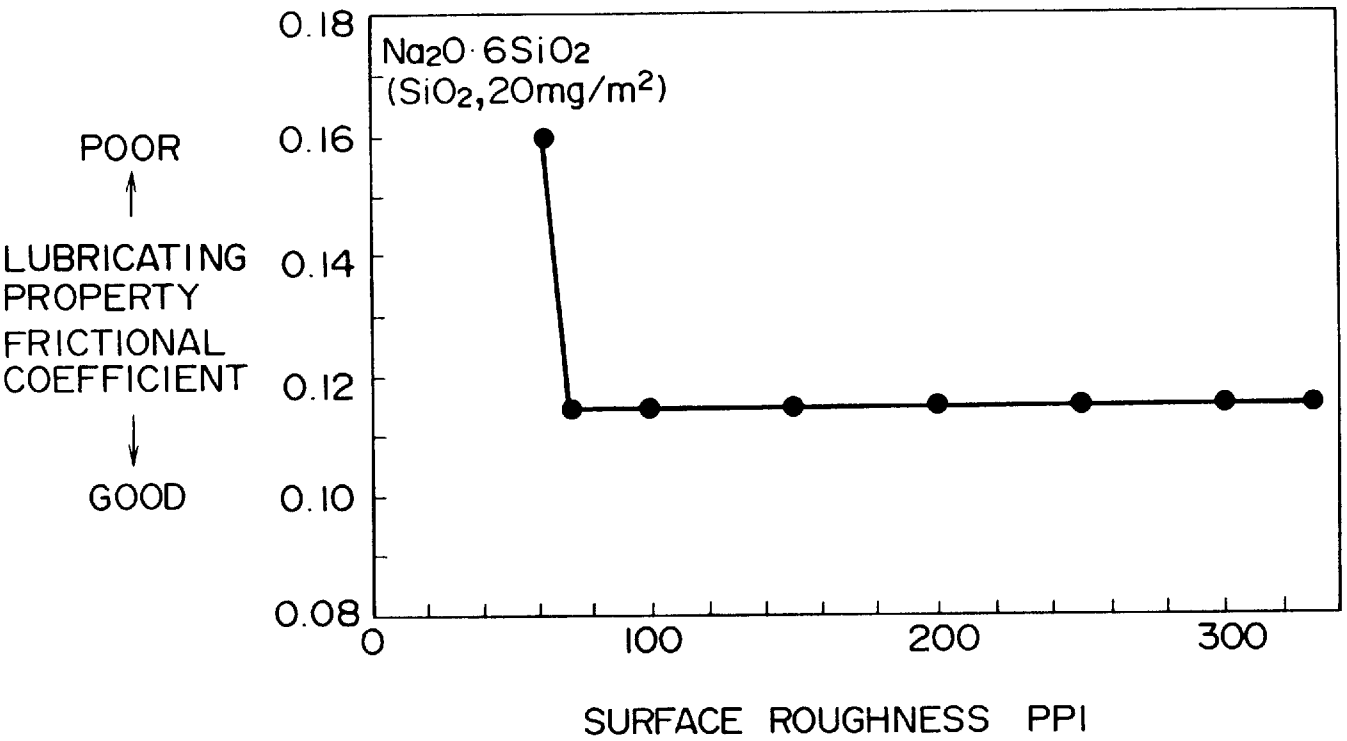
FIG. 4 depicts a graph representing the relation between the surface roughness PPI of a galvannealed steel sheet and the lubricating property.

FIG. 3 shows the results of the examination of the relation between the surface roughness (Ra) and the lubricating property when $Na_2O{\cdot}6SiO_2$ (of 20 mg/m$^2$ $SiO_2$) is coated on a galvannealed steel sheet; FIG. 4 shows the results of the examination of the relation between the surface roughness (PPI) and the lubricating property when $Na_2O{\cdot}6SiO_2$ (of 20 mg/m$^2$ $SiO_2$) is coated on the steel sheet. Frictional coefficient is used as the indicator of lubricating property, which is measured in the same manner as described above.

As apparently shown in these figures, silicate containing coatings defined in accordance with the present invention, if formed, have got the increase of the frictional coefficient at a surface roughness Ra of less than 0.5 μm or PPI of more than 300, so that dice scratch occurs on the sliding face of a molded article (after molding), which induces the deterioration of the lubricating property. Alternatively, the sharpness after coating is deteriorated, disadvantageously, at Ra of 1.5 μm and PPI of more than 300. The lower limit is preferably Ra 0.7 μm and PPI 120; more preferably Ra 0.75 μm and PPI 150; and most preferably Ra 1.1 μm and PPI 200.

For the purpose of improving further these characteristic performance of the steel sheet of the present invention, the following compositions 1 to 4 should be recommended.

1. Wax particles of dispersing type in water should be contained in the coating.

As the wax particles of dispersing type in water, in accordance with the present invention, use is made of particulate wax of dispersing type in water and with low-softening points, such as carnauba wax as a natural wax, line wax, montane wax, and paraffin wax, which are commercially available as Slip Aide SL-506, SL-508, and SL-511 (all manufactured by Sun Nopco, Co. Ltd.), Pasran No.52 (manufactured by Kyoei-sha Yushi Kagaku Kogyo, KK), Hoechst Wax Emulsion J-120 (manufactured by Hoechst Japan, Co. Ltd.), and the like; use is made of particulate wax of dispersing type in water and with high-softening points, such as low-molecular polyethylene wax as one synthetic wax, polyethylene oxide, and polypropylene oxide, which are commercially available as Dijet E-17 (manufactured by Go-o Kagaku, K.K.), KUE-1, KUE-5, KUE-7, KUE-8, KUE-11 (all manufactured by Sanyo Chemical Industry, Co. Ltd.), Chemipearl W-100, W-200, W-300, W-400, W-500, WF-640, W-900, W-950 (manufactured by Mitsui Petroleum Industry, Co. Ltd.), Eponol and Eponol HC-1 (manufactured by Ipposha Yushi, K.K.), Elepon E-20 (manufactured by Nikka Kagaku, K.K.) and the like.

2. One or more oxides of Zn oxides, Ni oxides, Co oxides, Fe oxides, P oxides, B oxides, Ca oxides, Mo oxides, W oxides, V oxides and the like should be contained in the $SiO_2$ coating. If the deposition of these oxides is below 1 mg/m$^2$, not any effect of improving the lubricating property is exerted; above 100 mg/m$^2$, the adhesion with adhesive in oil and the phosphatability are deteriorated. Thus, the deposition is within a range of 1 to 100 mg/m$^2$ (as the level of Zn, Ni, Co, Fe, P, B, Ca, Mo, W and V).

3. Press molding of automobiles is generally carried out at oil coated state. Thus, after coating silicic acid (silicate) on the surface of the steel sheet, an oil of a viscosity of 5 to 50 mm$^2$/s at 40° C. is subsequently coated thereon. If the viscosity of such oil is below 5 mm$^2$/s, the lubricating property is never improved; above 50 mm$^2$/s, alternatively, degreasing is hardly effected at the phosphatizing process, thus deteriorating the phosphatability.

4. The Fe content in the plated layer of a galvannealed steel sheet is preferably 7 to 15%. Below 7%, the soft ζ phase mostly remains to deteriorate the sliding property; above 15%, alternatively, the powdering property is deteriorated. Even if the Fe content is within a range of 7 to 9%, the soft ζ phase is slightly present, which more or less decreases the sliding property. Therefore, the range should be recommended to be 9 to 14%.

Then, description will be made of the lubricant film coated steel sheet with excellent phosphatability and further with improved adhesion with adhesive in oil. The present inventors have made investigations about modification of the distribution of silicic acid (silicate) coating on the steel sheet. The inventors have found that preferential deposition of silicic acid (silicate) on the recess parts of the surface of the steel sheet can improve the adhesion with adhesive in oil, with no deterioration of the lubricating property or phosphatability. The reason may be as follows. The adhesion with adhesive in oil and phosphatability of the steel sheet coated with silicic acid (silicate), depend on the coating ratio of silicic acid (silicate). If silicic acid (silicate) coats the sheet uniformly and strongly, the steel sheet or the plated layer is left in so insufficient contact to the adhesive or phosphatizing solution that the adhesion with adhesive in oil and phosphatability are deteriorated. On the contrary, by preferentially depositing silicic acid (silicate) on the recess parts of the steel sheet or the plated layer to control the deposition on the protrusion parts to a lower level, the steel sheet or the plated layer is readily put in contact to the adhesive or the phosphatizing solution, so that the adhesion with adhesive in oil and phosphatability may be improved remarkably. Herein, the lubricating property is so satisfactory if a given amount of silicic acid (silicate) is present on the recess parts.

So as to effectively exert the lubricating action of such silicic acid (silicate) used for coating with no deterioration of adhesion with adhesive in oil or phosphatability, coating should be effected to a final $SiO_2$ weight of 1 to 200 mg/m$^2$ after drying and to a final B/A ratio of 1.2 or more, provided that A and B are $SiO_2$ deposition at the protrusion parts of the steel sheet and the recess parts thereof, respectively. The reasons why these values are thus determined are described with reference to FIGS. 5 and 6.

Figure 5:
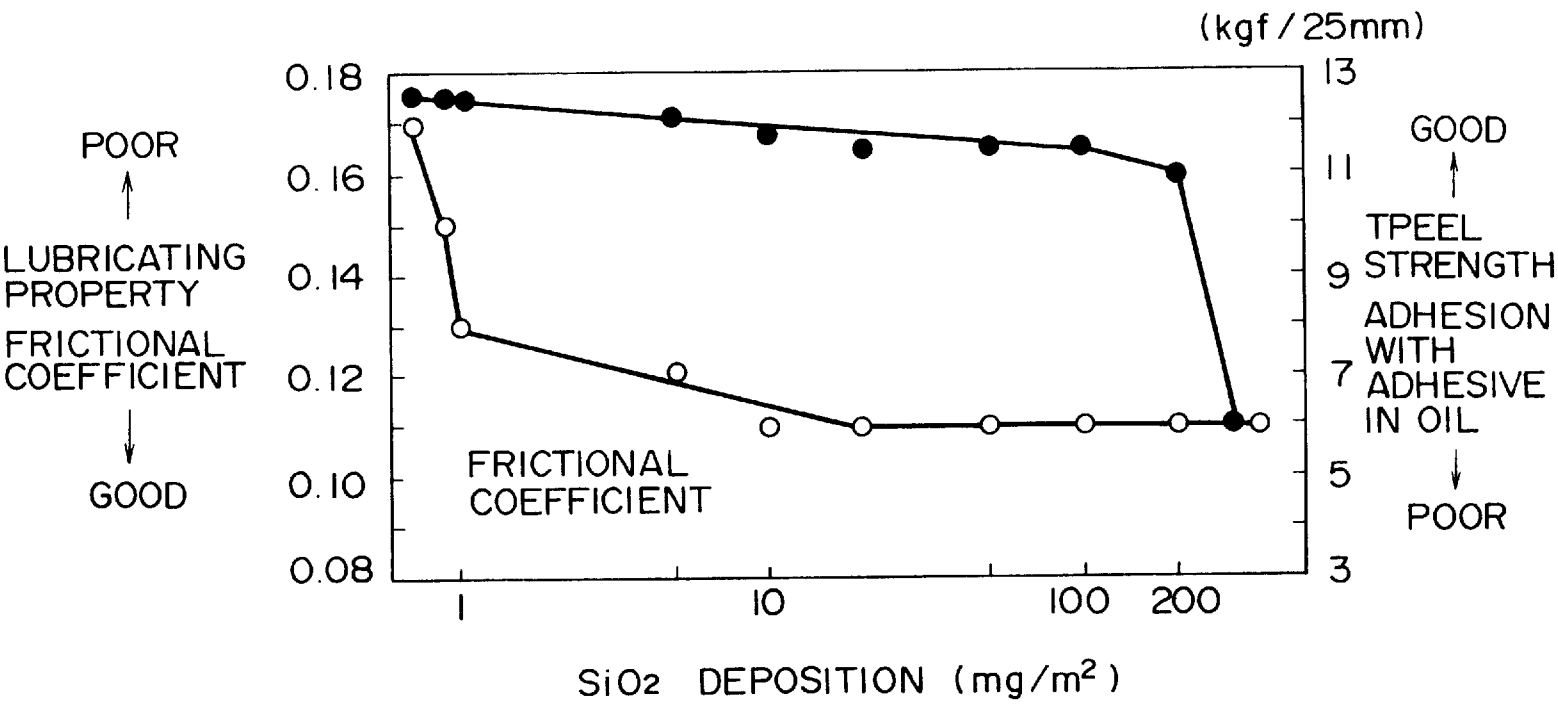
FIG. 5 depicts graphs representing the relation between $SiO_2$ deposition and lubricating property and adhesion with adhesive in oil.

FIG. 5 depicts the results of the examination of the relation between $SiO_2$ deposition and the lubricating property and adhesion with adhesive in oil, when $SiO_2$ is coated on the following galvannealed steel sheet Deposition; 60 g/m$^2$.

Fe content; 11%.

Ra; 1.0.

PPI; 130.

Experimental conditions for assessing the lubricating property were the same as the conditions adopted for the results of FIG. 1, except that the sample size was 40×250 mm.

The adhesion with adhesive in oil was assessed, by measuring the T peel strength of a steel sheet bonded with an adhesive by the following method.

Sample size; 20×200 mm.

Coating oil; Noxrust 550 (manufactured by Parker Kosan), 2 g/m$^2$.

Adhesive; vinyl chloride PV 5306 (manufactured by Henchel Hakusui).

Bonding method; inserting an adhesive in between two steel sheets, then inserting SUS wire of a diameter of 0.15 mm at a pitch of about 30 mm, and fixing the two sheets with a clip or the like.

Baking; 160° C. for 10 min.

Annealing; left to stand in atmosphere at 20° C. and 65 RH % for 22 hours.

T peeling; tensile velocity of 200 mm/min.

Process; oil coating→bonding→baking→annealing→T peeling

Figure 6:
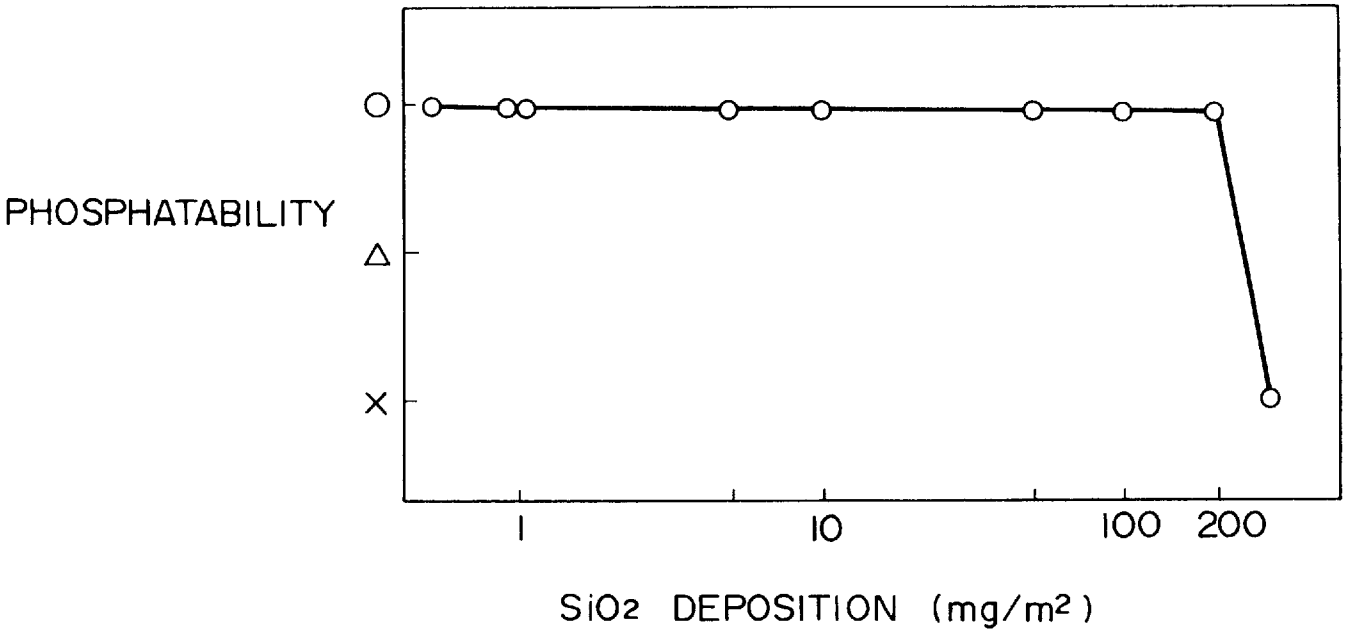
FIG. 6 depicts graphs representing the relation between $SiO_2$ deposition and phosphatability.

FIG. 6 depicts the results of the examination of the relation between the amount of coated $SiO_2$ and the phosphatability, when $SiO_2$ is coated on the galvannealed steel sheet.

Experimental conditions to assess the phosphatability were the same as those adopted for recovering the results of FIG. 1.

As apparently shown in FIGS. 5 and 6, the frictional coefficient is greatly decreased above 1 mg/m$^2$ $SiO_2$, to consequently improve the lubricating property. The results coincide with the results of FIGS. 1 and 2. Above 200 mg/m$^2$ $SiO_2$, herein, the adhesion with adhesive in oil and the phosphatability are severely deteriorated, so the upper limit should be 200 mg/m$^2$. The lower limit is preferably 10 mg/m$^2$, more preferably 20 mg/m$^2$ or more. The upper limit is preferably 100 mg/m$^2$, more preferably 60 mg/m$^2$ or less.

Figure 7:
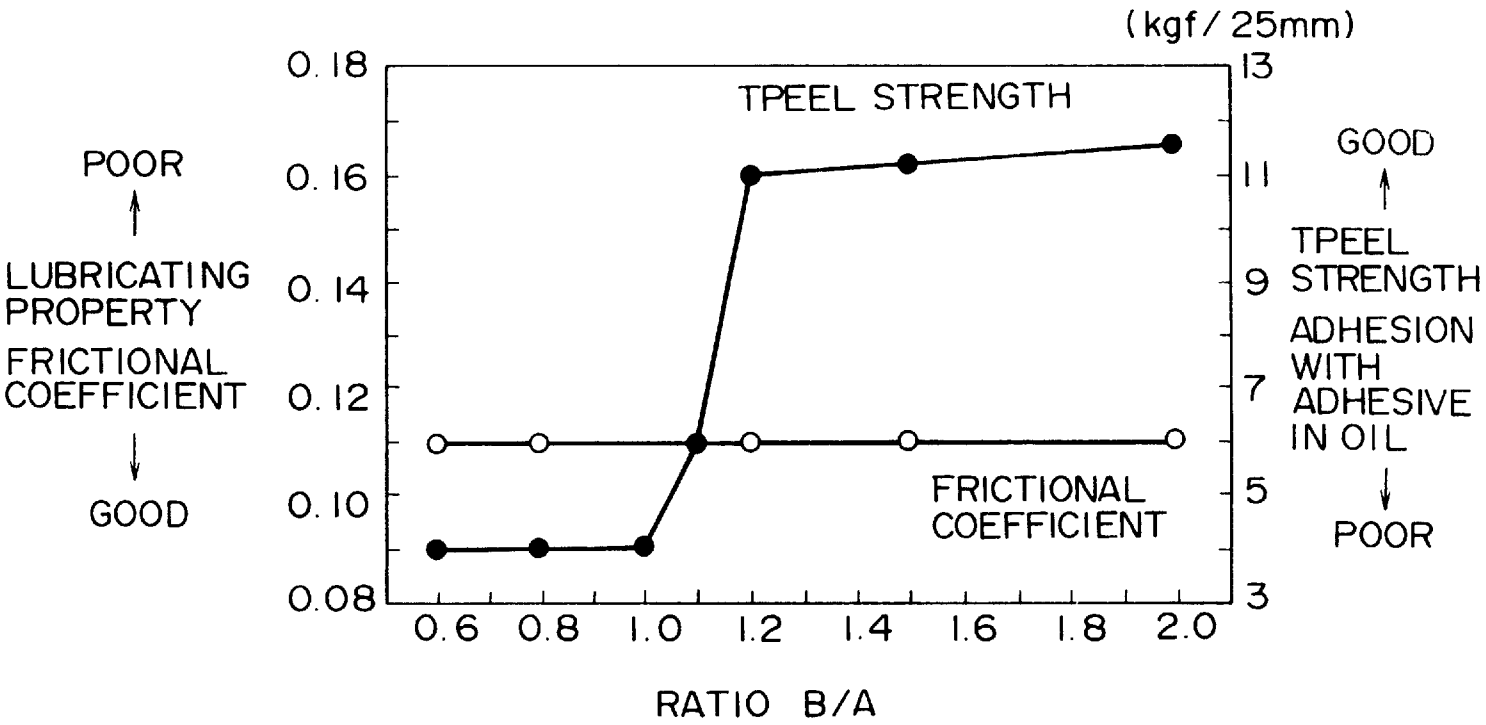
FIG. 7 depicts graphs representing the relation of B/A wherein A and B are designated as the $SiO_2$ deposition at the protrusion parts of the surface of a galvannealed steel sheet and the $SiO_2$ deposition at the recess parts thereof, with the lubricating property and phosphatability.

FIG. 7 shows the results of the examination of the relation of B/A wherein A and B are designated as the $SiO_2$ deposition at the protrusion parts of the surface of a galvannealed steel sheet and the $SiO_2$ deposition at the recess parts thereof, respectively, with the lubricating property and phosphatability. Experimental conditions were substantially the same as the conditions adopted for recovering the results of FIG. 5, except that the $SiO_2$ deposition was set to 30 mm/m$^2$.

Figure 8:
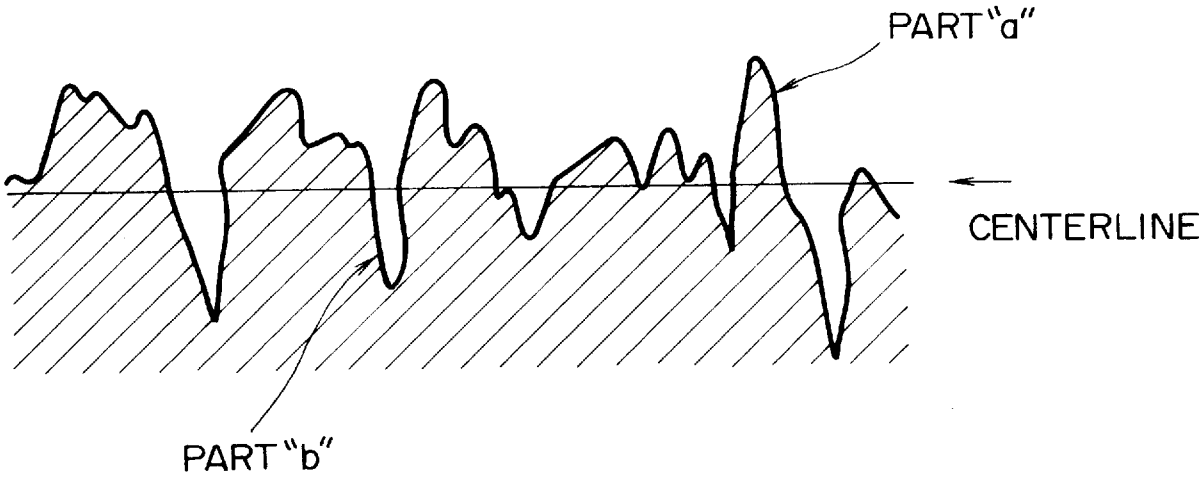
FIG. 8 is an explanatory view of a roughness curve of a steel sheet or a plated steel sheet (excluding galvannelaed steel sheet), wherein the protrusion parts (a) and recess parts (b) are shown.

Fine recesses and protrusions are present on the surface of any steel sheet, but simple observation of these protrusion and recess parts from the surface cannot discriminate them from each other. Thus, by measuring the profile of the surface roughness, parts positioned above and below the center line of the resulting roughness curve are defined as protrusion parts and recess parts, respectively. In one roughness curve illustration shown in FIG. 8, for example, the mountainous parts (a) positioned above the center line are defined as the protrusion parts, while the trough parts (b) positioned below the center line are defined as the recess parts.

Figure 9:
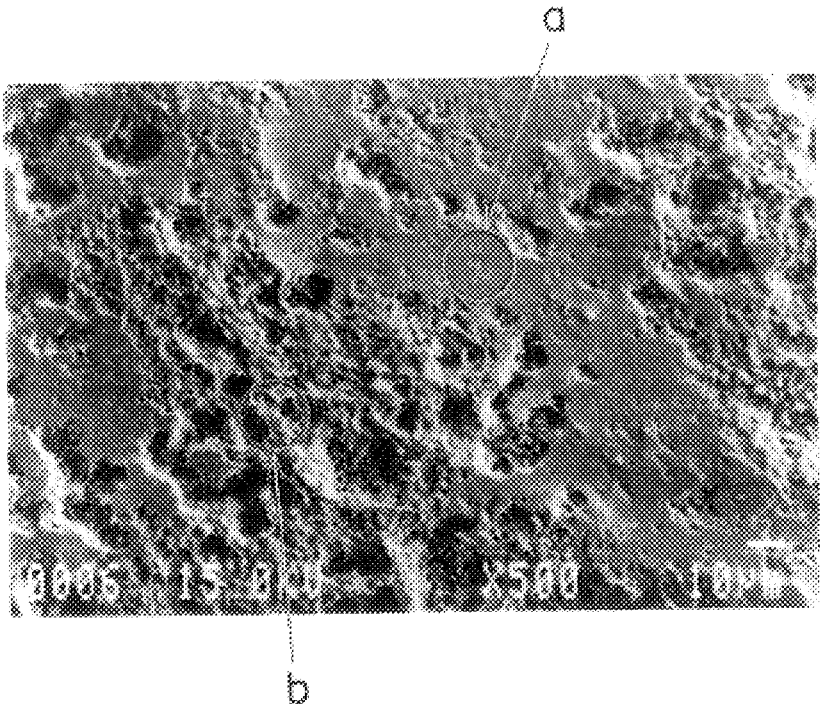
FIG. 9 is an SEM photograph under EPMA observation of the plated surface of a galvannealed steel sheet, which is a drawing alternative and shows the protrusion part (a) and recess part (b) on the galvannealed surface.

However, the protrusion parts of a galvannealed steel sheet are crushed into smooth face at skin pass rolling after galvanization. When such plain part is formed through skin pass rolling, therefore, the $SiO_2$ deposition at the plain part is defined as the $SiO_2$ deposition A on the protrusion parts, while the $SiO_2$ deposition in the trough parts, other than the deposition described above, is defined as the $SiO_2$ deposition B on the recess parts. The plain part (protrusion parts) and the trough parts (recess parts) are readily identified under SEM or EPMA observation. FIG. 9 is an SEM picture photographed under EPMA observation of the surface of the galvannealed layer, wherein "a" is the protrusion part and "b" is the recess part. The ratio B/A for the $SiO_2$ depositions A and B on the protrusion and recess parts, respectively, can be determined by measuring individually the Si-peak intensity on the protrusion and recess parts by for example energy dispersive X-ray spectrometry (EDS; acceleration voltage of for example 20 kV).

B/A=(Si intensity at the recess part)/(Si intensity at the protrusion part)

As apparently shown in the results of FIG. 7, the lubricating property of the galvannealed steel sheet is excellent, despite the ratio B/A. Because the adhesion with adhesive in oil is severely deteriorated when the ratio B/A is below 1.2, however, the ratio B/A should necessarily be 1.2 or more. The lower limit is preferably 1.5, more preferably 2.0 or more.

So as to preferentially deposit silicic acid (silicate) on the recess parts of the surface of the steel sheet, it is recommended that the concentration of alkali components such as $Na_2O$, $K_2O$, and $Li_2O$ in the coating of silicic acid (silicate) should be adjusted to a given value or less. The uniformity and intensity of the coating of silicic acid (silicate) depends greatly on the concentration of alkali components such as $Na_2O$, $K_2O$, and $Li_2O$ in the coating; as the increase of the concentration of these alkali components, silicic acid (silicate) effects coating more uniformly and more intensely. If the concentration of alkali components is lowered, then, the uniformity and intensity of the coating of silicic acid (silicate) decreases, which turns the surface into a porous and non-uniform state. Therefore, the steel sheet or the plated layer is readily put in contact to an adhesive or a phosphatizing solution, which can improve the adhesion with adhesive in oil and phosphatability. More specifically, it is recommended that the ratio of $Na_2O+K_2O+Li_2O/SiO_2$ in the silicic acid (silicate) coating should be 3% or less. The reason will now be described with reference to FIGS. 10 and 11.

Figure 10:
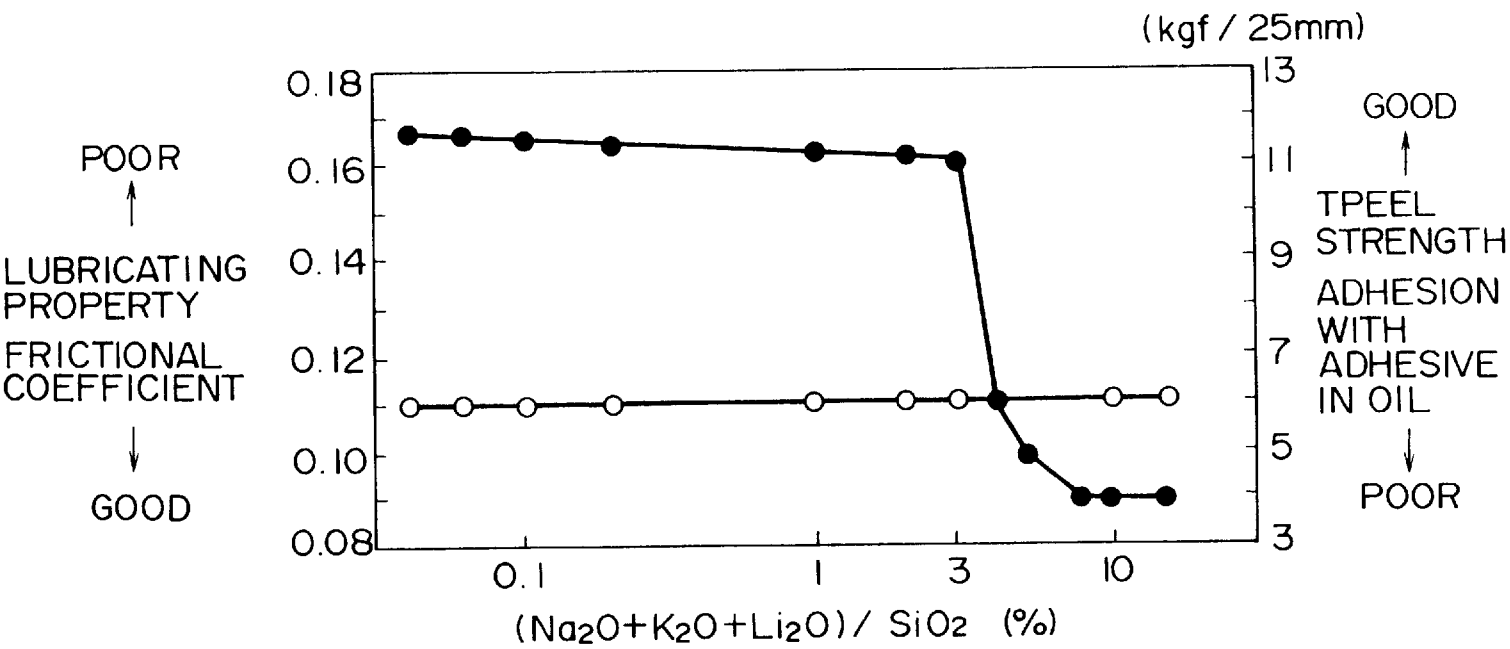
FIG. 10 depicts graphs representing the relation between the percentage by weight of $(Na_2O+K_2O+Li_2O)/SiO_2$ in a silicic acid coating and lubricating property and adhesion with adhesive in oil.
Figure 11:
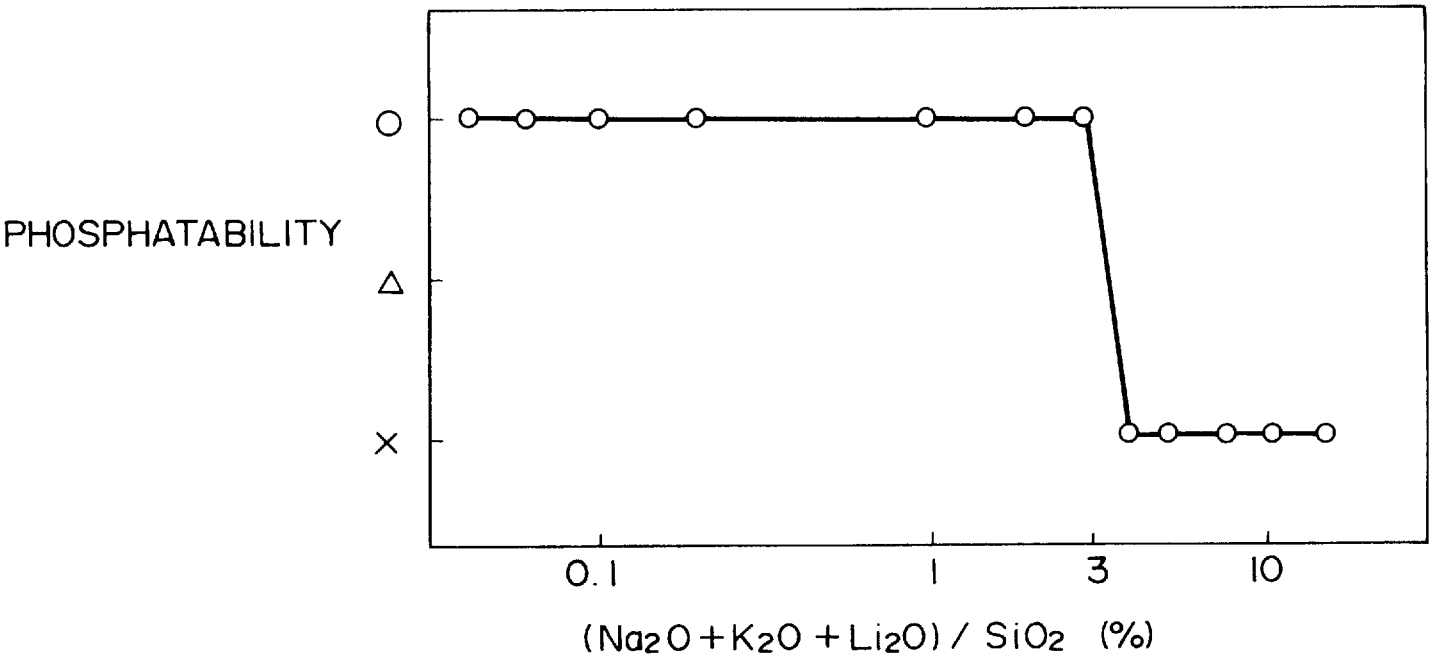
FIG. 11 depicts graphs representing the relation between the percentage by weight of $(Na_2O+K_2O+Li_2O)/SiO_2$ in a silicic acid coating and lubricating property and phosphatability.

FIG. 10 depicts graphs representing the relation of the percentage by weight of $(Na_2O+K_2O+Li_2O)/SiO_2$ (namely, the ratio of alkali components to $SiO_2$) in the silicic acid coating, with the lubricating property and the adhesion with adhesive in oil, when 30 mg/m$^2$ $SiO_2$ is coated onto a galvannealed steel sheet; and FIG. 11 depicts graphs representing the relation between the percentage by weight of $(Na_2O+K_2O+Li_2O)/SiO_2$ in the silicic acid coating and the phosphatability, when $SiO_2$ is coated onto a galvannealed steel sheet. Experimental conditions were substantially the same as the conditions for recovering the results of FIG. 5; and the lubricating property, adhesion with adhesive in oil and phosphatability were assessed in the same manner. Herein, the deposition of $Na_2O$, $K_2O$, and $Li_2O$ was determined by measuring the concentrations of Na, Li, K and Si by fluorescent x-ray spectrometry, ICP, or atomic absorption spectrometry.

As shown in FIGS. 10 and 11, apparently, the lubricating property of the galvannealed steel sheet is excellent despite the percentage by weight of $(Na_2O+K_2O+Li_2O)/SiO_2$ in the $SiO_2$ coating. Because the adhesion with adhesive in oil and the phosphatability are distinctively deteriorated when the percentage by weight of $(Na_2O+K_2O+Li_2O)/SiO_2$ is above 3%, however, the percentage by weight of $(Na_2O+K_2O+Li_2O)/SiO_2$ should necessarily be 3% or less. The upper limit is preferably 1%, more preferably 0.3% or less.

As has been described above, Japanese Patent Laid-open Nos. Sho 55-110783 and 60-63394 describe plated steel plates with $SiO_2$ deposition on the galvanized layer thereof for the purpose of improving the spot weldability, wherein $SiO_2$ layer is simply formed on the galvanized layer so as to improve the spot weldability. Therefore, the objects of these references are different from the objects of the present invention. From the respect of micro-fine composition, additionally, the $SiO_2$ coating is formed in a quite different manner. More specifically, the $SiO_2$ coating is conventionally formed at an approximately uniform thickness irrespective of the recess and protrusion parts in galvanized steel sheets . However, the coating is formed at a larger thickness at the recess part and at a smaller thickness at the protrusion part in the lubricant film coated steel sheet in accordance with the present invention.

The method for producing a lubricant film coated steel sheet will be described in accordance with the present invention.

The surface roughness of a base steel sheet should be controlled by using indicators such as degree of roll roughness during skin pass rolling, skin pass draft, roughness of plating base sheet, and Al concentration in a bath.

On the surface of the steel sheet under control of the surface roughness by such manner, coating containing silicic acid (silicate) is coated. Specifically, such coating is formed by coating an aqueous solution of silicate or a colloidal solution of silicic acid on the steel sheet and therafter drying the solution. Such aqueous solution of silicic acid includes sodium silicate, potassium silicate, lithium silicate and the like as described above; such colloidal solution of silicic acid includes a colloidal solution of particulate silicic anhydride dispersed in water as a dispersing medium. Herein, the colloidal solutions is commercially available in the form of colloidal silica or colloid sol, as for example Snow Tex 20, Snow Tex 40, Snow Tex N, Snow Tex S, Snow Tex K, Lithium Silicate 35, Lithium Silicate 45, Lithium Silicate 75, and Snow Tex XS (all manufactured by Nissan Chemical, Co. Ltd.).

The method for coating the aqueous solution of silicate or the colloidal solution of silicic acid on the surface of steel sheet includes, with no specific limitation, a method comprising immersing the sheet in the aqueous solution, a coating method by means of a roll coater, a spray coating method, general coating methods and the like.

So as to form the coating containing silicic acid (silicate) on the surface of a steel sheet in a porous and non-uniform fashion to preferentially deposit silicic acid or silicate on the recess parts of the surface of the steel sheet, for the purpose of improving the adhesion with adhesive in oil, still furthermore, it is necessary to decrease the concentration of alkali components in the silicic acid (silicate) solution, as has been described above. Besides, it is recommended a method to control the particle size of $SiO_2$ particles, a method to form $SiO_2$ particles into a rod-like shape, or a method to decrease the pH of the bath and the like.

Figure 12:
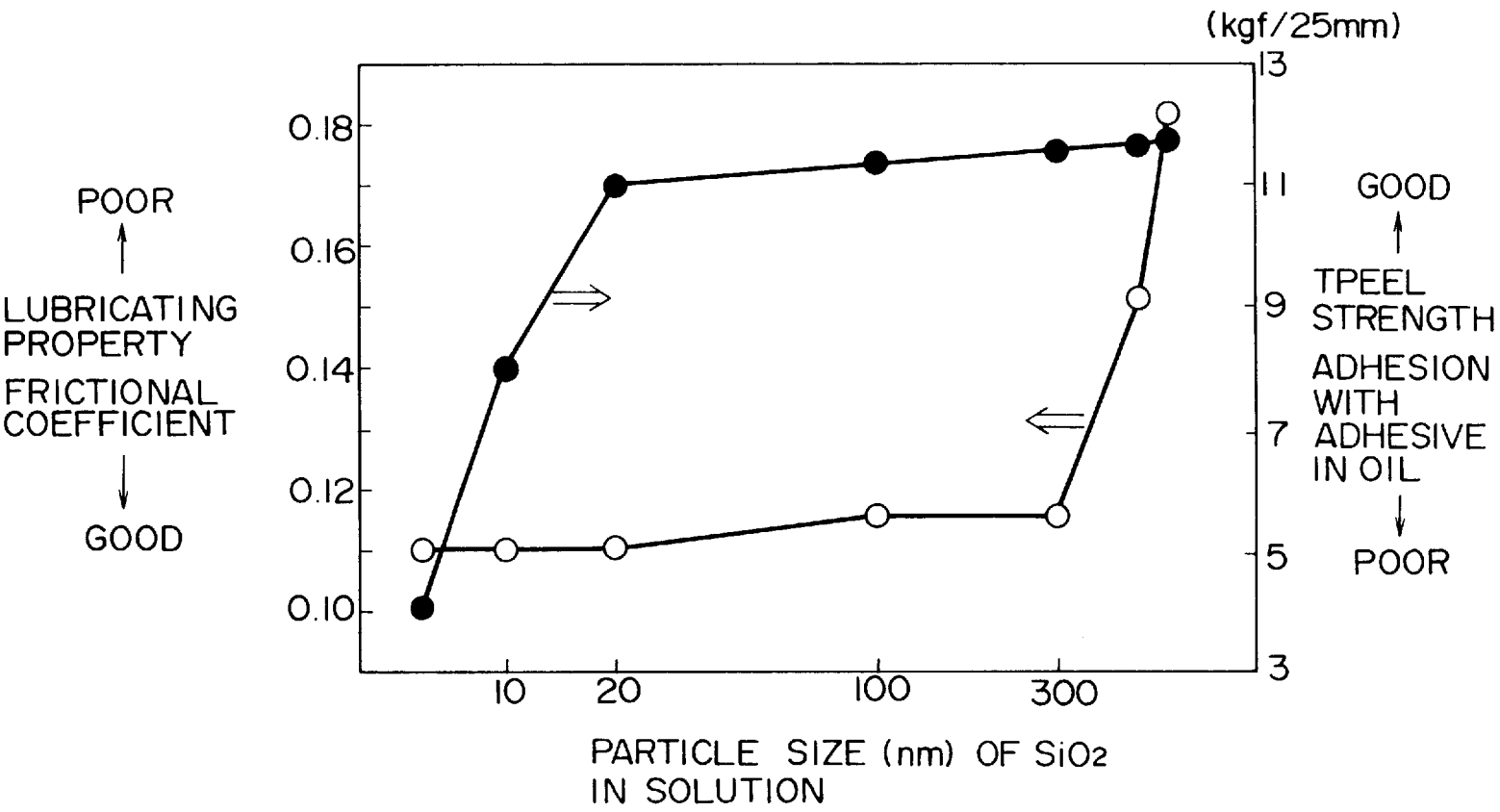
FIG. 12 depicts a graph representing the relation between the particle size of $SiO_2$ particles in a solution and lubricating property and adhesion with adhesive in oil.
Figure 13:
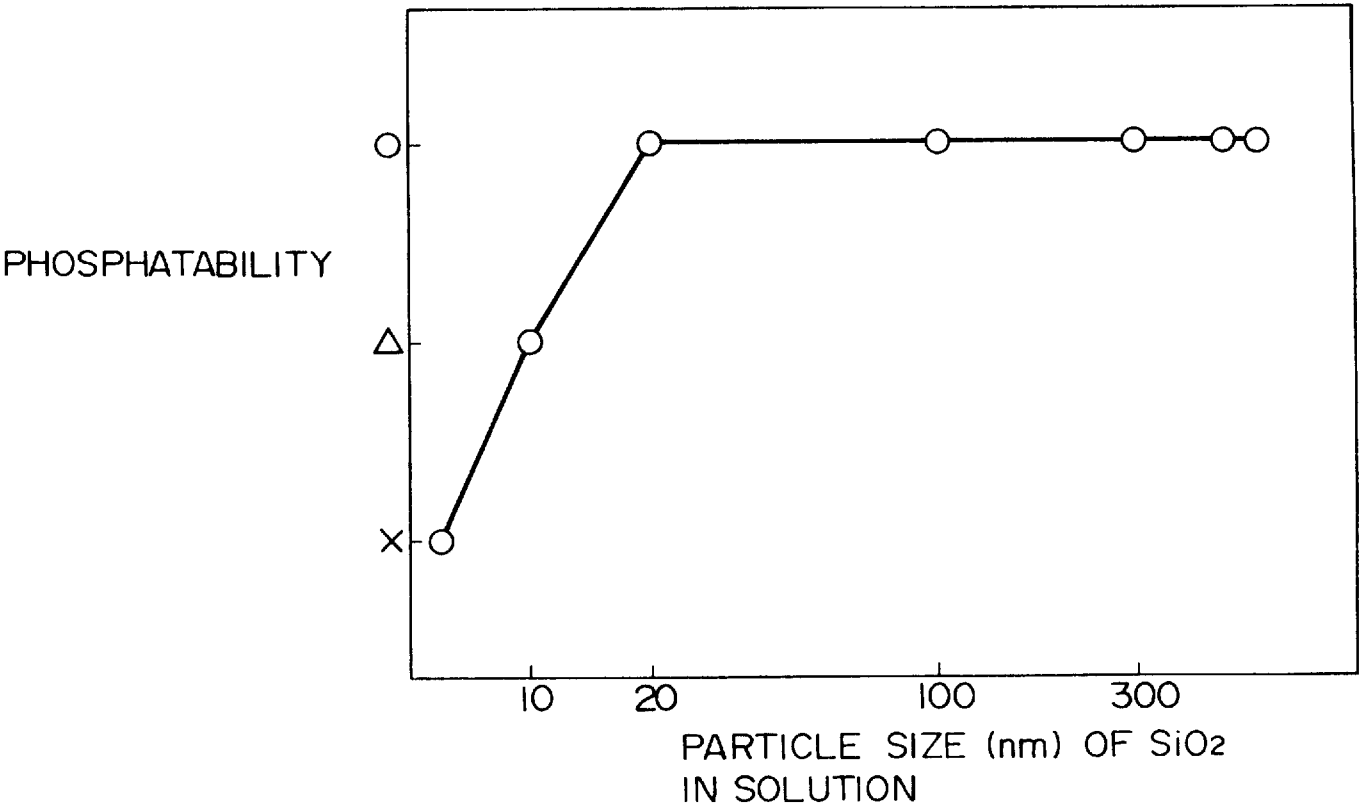
FIG. 13 depicts a graph representing the relation between the particle size of $SiO_2$ particles and phosphatability.

FIG. 12 depicts a graph representing the effect of the particle size of $SiO_2$ particles in the solution containing silicic acid on the lubricating property and the adhesion with adhesive in oil, when the solution is coated on a galvannealed steel sheet; and FIG. 13 depicts a graph representing the effect of the particle size of $SiO_2$ particles on the phosphatability.

As apparently shown in FIGS. 12 and 13, the coating turns too porous and non-uniform so that the lubricating property is deteriorated, when the particle size of $SiO_2$ particles in the solution is above 300 nm; adversely when the particle size is less than 20 nm, the coating turns uniform and intense to deteriorate the adhesion with adhesive in oil and the phosphatability. From these results, thus, it is indicated that the particle size of $SiO_2$ particles is preferably within a range of 20 to 300 nm so as to exert the effect of the present invention. The particle size of $SiO_2$ particles is preferably within a range of 20 to 100 nm, more preferably within a range of 30 to 50 nm.

The $SiO_2$ particles used were spherical in liquid, but the shape of the $SiO_2$ particles is not limited to such spherical shape. $SiO_2$ particles in a rod-like shape may be used satisfactorily. From the respect of the lubricating property, adhesion with adhesive in oil and phosphatability of a galvannealed steel sheet, in particular, the $SiO_2$ particles of a rod-like shape may rather be preferably used. In other words, the particles of a rod-like shape rather than those of a spherical shape can yield stable and excellent lubricating property, adhesion with adhesive in oil and phosphatability.

The reason why the use of rod-like $SiO_2$ particles can bring about the effect described above is not elucidated, but possibly, the porosity and non-uniformity of the silicic acid coating on the surface of the steel sheet may then be adjusted appropriately. However, such rod-like $SiO_2$ particles may preferably have a size (D) of 1 to 50 nm and a length (T) of 20 to 300 nm, provided that D<T. If the size (D) is less than 1 nm, the coating is so dense to deteriorate the adhesion with adhesive in oil and the phosphatability; above 500 nm, the coating turns so porous to deteriorate the lubricating property. Similarly, when the length (T) is less than 20 nm, the coating is so dense to deteriorate the adhesion with adhesive in oil and phosphatability; above 300 nm, the coating is so porous to deteriorate the lubricating property. The upper limits of the size and length are preferably 30 nm and 200 nm, respectively. The lower limits thereof are preferably 5 nm and 50 nm, more preferably 10 nm and 100 nm, respectively.

The $SiO_2$ content in water is necessarily 0.1 g/liter or more. More specifically, if the $SiO_2$ content is less than 0.1 g/liter, the $SiO_2$ deposition in the coating is so less to hardly improve the lubricating property.

The temperature for drying the coated solution is preferably 80° C. or more, after a colloidal solution of silicic acid or a solution containing silicate is coated on the surface of a galvanized steel sheet. If the temperature is below 80° C., the water contained in the coating is so insufficiently removed that excellent lubricating property cannot be procured.

Furthermore, the "r" value is preferably 1.4 to 2.3 after silicic acid (silicate) is coated on the steel sheet. If the "r" value is less than 1.4, crack may readily occur during press molding even after silicic acid (silicate) is coated; if the "r" value is above 2.3, the effect is saturated, involving the escalation of the production cost. Herein, the "r" value means Rankford value, which is measured by giving 15% tensile deformation to a sample piece for tensile test, according to JIS No. 13-B.

The present invention will now be described hereinbelow in examples, but the invention is not at all limited to the examples. Modification and variation of the invention is entirely within the technical scope of the present invention, without departing from the spirit of the invention described insofar and hereinbelow.

DESCRIPTION OF PREFERRED EMBODIMENTS

EXAMPLE 1

In the present example, the effect of deposition of silicate or silicic acid on lubricating property and phosphatability was examined.

Solutions containing given volumes of a variety of silicate or silicic acid ($SiO_2$ colloidal solution) shown in Tables 1 and 2 were coated on galvannealed steel sheets of 60 g/m$^2$ deposition, by means of a pinch roll. The $SiO_2$ weight after drying is concurrently shown in Tables 1 and 2. The solution was dried at 80° C. after coating, to form a hard $SiO_2$ coating.

The galvanized steel sheets with coatings containing a variety of silicate and silicic acid, produced by such manner, were assessed of their lubricating property (frictional coefficient and dice scratch resistance), and phosphatability. Among them, frictional coefficient and phosphatability were assessed in the same manner as for the experimental method concerning FIG. 1; and dice scratch resistance was measured as follows.

Performing a single press test by using a 80-t crank press system, the dice scratch resistance on the sliding part of a molded article was visually observed. The results are divided according to the following standards.

◎; no scratching;
○; almost no scratching;
Δ; slightly larger scratching;
×; larger scratching.

These results are concurrently shown in Tables 1 and 2.

TABLE 1

| | Galvannealed steel sheet | | | Silicate or silicic acid | | Lubricating property | | |
|---|---|---|---|---|---|---|---|---|
| No. | Fe (%) | Ra (μm) | PPI | Type | SiO2 deposition (mg/m2) | Frictional coefficient | Dice scratch resistance | Phosphatability |
| 1 | 10.0 | 1.0 | 150 | $Na_2O—6SiO_2$ | 10 | 0.11 | ◎ | ○ |
| 2 | 10.0 | 1.0 | 150 | " | 50 | 0.11 | ◎ | ○ |
| 3 | 10.0 | 1.0 | 150 | " | 100 | 0.11 | ◎ | ○ |
| 4 | 10.0 | 1.0 | 150 | " | 200 | 0.10 | ◎ | ○ |
| 5 | 10.0 | 1.0 | 150 | " | 1 | 0.12 | ◎ | ○ |
| 6 | 10.0 | 1.0 | 150 | $Na_2O—5SiO_2$ | 10 | 0.11 | ◎ | ○ |
| 7 | 10.0 | 1.0 | 150 | $Na_2O—3SiO_2$ | 10 | 0.11 | ◎ | ○ |
| 8 | 10.0 | 1.0 | 150 | $Na_2O—7SiO_2$ | 10 | 0.11 | ◎ | ○ |
| 9 | 10.0 | 1.0 | 150 | $Na_2O—8SiO_2$ | 10 | 0.11 | ◎ | ○ |
| 10 | 10.0 | 1.0 | 150 | $Na_2O—3SiO_2$ | 10 | 0.11 | ◎ | ○ |
| 11 | 10.0 | 1.0 | 150 | $Na_2O—5SiO_2$ | 10 | 0.11 | ◎ | ○ |
| 12 | 10.0 | 1.0 | 150 | $Na_2O—6SiO_2$ | 10 | 0.11 | ◎ | ○ |
| 13 | 10.0 | 1.0 | 150 | $Na_2O—8SiO_2$ | 10 | 0.11 | ◎ | ○ |
| 14 | 10.0 | 1.0 | 150 | $K_2O—3SiO_2$ | 20 | 0.11 | ◎ | ○ |

TABLE 1-continued

| | Galvannealed steel sheet | | | Silicate or silicic acid | | Lubricating property | | |
|---|---|---|---|---|---|---|---|---|
| No. | Fe (%) | Ra (μm) | PPI | Type | SiO2 deposition (mg/m2) | Frictional coefficient | Dice scratch resistance | Phosphatability |
| 15 | 10.0 | 1.0 | 150 | $K_2O—5SiO_2$ | 20 | 0.11 | ◎ | ○ |
| 16 | 10.0 | 1.0 | 150 | $K_2O—6SiO_2$ | 20 | 0.11 | ◎ | ○ |
| 17 | 10.0 | 1.0 | 150 | $K_2O—8SiO_2$ | 20 | 0.11 | ◎ | ○ |
| 18 | 9.0 | 1.0 | 150 | $Na_2O—6SiO_2$ | 20 | 0.11 | ◎ | ○ |
| 19 | 8.0 | 1.0 | 150 | " | 20 | 0.12 | ◎ | ○ |
| 20 | 7.0 | 1.0 | 150 | " | 20 | 0.13 | ◎ | ○ |
| 21 | 12.0 | 1.0 | 150 | " | 20 | 0.11 | ◎ | ○ |
| 22 | 14.0 | 1.0 | 150 | " | 20 | 0.11 | ◎ | ○ |
| 23 | 10.0 | 0.7 | 150 | " | 20 | 0.11 | ◎ | ○ |
| 24 | 10.0 | 0.9 | 150 | " | 20 | 0.11 | ◎ | ○ |
| 25 | 10.0 | 1.2 | 150 | " | 20 | 0.11 | ◎ | ○ |
| 26 | 10.0 | 1.4 | 150 | " | 20 | 0.11 | ◎ | ○ |
| 27 | 10.0 | 1.0 | 100 | " | 20 | 0.11 | ◎ | ○ |
| 28 | 10.0 | 1.0 | 130 | " | 20 | 0.11 | ◎ | ○ |
| 29 | 10.0 | 1.0 | 200 | " | 20 | 0.11 | ◎ | ○ |
| 30 | 10.0 | 1.0 | 250 | " | 20 | 0.11 | ◎ | ○ |
| 31 | 10.0 | 1.0 | 150 | " | 10 | 0.11 | ◎ | ○ |
| 32 | 10.0 | 1.0 | 150 | " | 50 | 0.11 | ◎ | ○ |
| 33 | 10.0 | 1.0 | 150 | " | 100 | 0.11 | ◎ | ○ |
| 34 | 10.0 | 1.0 | 150 | " | 200 | 0.10 | ◎ | ○ |
| 35 | 10.0 | 1.0 | 150 | $Na_2O—2SiO_2$ | 10 | 0.14 | ○ | ○ |
| 36 | 10.0 | 1.0 | 150 | $Na_2O—9SiO_2$ | 10 | 0.11 | ◎ | ○ |
| 37 | 6.8 | 1.0 | 150 | $Na_2O—6SiO_2$ | 20 | 0.14 | ◎ | ○ |
| 38 | 15.0 | 1.0 | 150 | $Na_2O—6SiO_2$ | 10 | 0.11 | ◎ | ○ |
| 39 | 10.0 | 0.6 | 150 | $SiO_2$ | 20 | 0.11 | ◎ | ○ |
| 40 | 10.0 | 0.5 | 150 | " | 20 | 0.11 | ◎ | ○ |
| 41 | 10.0 | 1.0 | 75 | " | 20 | 0.11 | ◎ | ○ |

TABLE 2

| | Galvannealed steel sheet | | | Coating | | Lubricating property | | |
|---|---|---|---|---|---|---|---|---|
| No. | Fe (%) | Ra (μm) | PPI | Type | Deposition (mg/m2) | Frictional coefficient | Dice scratch resistance | Phosphatability |
| 42 | 10.0 | 1.0 | 150 | — | — | 0.16 | x | ○ |
| 43 | 10.0 | 1.0 | 150 | $Na_2O—6SiO_2$ | 0.5 | 0.16 | Δ | ○ |
| 44 | 10.0 | 1.0 | 150 | $Na_2O—6SiO_2$ | 220 | 0.10 | ○ | x |
| 45 | 10.0 | 0.4 | 150 | $Na_2O—6SiO_2$ | 20 | 0.14 | x | ○ |
| 46 | 10.0 | 1.0 | 70 | $NaO_2—6SiO_2$ | 20 | 0.16 | x | ○ |
| 47 | 10.0 | 1.0 | 70 | Mn oxide<br>Phosphoric acid | 50<br>40 | 0.15 | Δ | ○ |
| 48 | 10.0 | 0.4 | 150 | Mn oxide<br>Phosphoric acid | 50<br>40 | 0.15 | Δ | ○ |
| 49 | 10.0 | 0.4 | 70 | Mn oxide<br>Phosphoric acid | 50<br>40 | 0.16 | x | ○ |
| 50 | 10.0 | 1.0 | 150 | Mn oxide<br>Phosphoric acid | 50<br>40 | 0.14 | Δ | ○ |

The results of the Tables indicate what will be described hereinbelow.

Nos. 1 to 41 are galvanized steel sheets satisfying all the requirements of the present invention, with excellent lubricating property and phosphatability.

On the contrary, Nos. 42 to 50 which cannot satisfy one of the requirements of the present invention have the following disadvantages.

No. 42 has a larger frictional coefficient along with poor dice scratch resistance, because the sample does not have any coating containing silicate. Overall, the lubricating property is absolutely bad.

No. 43 is an example outside the lower limit of $SiO_2$ deposition, defined by the present invention, which has a larger frictional coefficient and slightly poor dice scratch resistance.

No. 44 is an example above the upper limit of $SiO_2$ deposition, defined by the present invention, which has a smaller frictional coefficient and good dice scratch resistance. However, the phosphatability is deteriorated.

Nos. 45 and 46 are examples with the surface roughness of the plated steel sheets below the requirements of the present invention, both of which have excellent phosphatability but poor lubricating property.

Nos. 47 through 50 are comparative examples wherein coatings containing Mn oxide and phosphoric acid are formed, instead of the silicate containing coating defined by the present invention. As apparently shown in the results of the Tables, examples with either one or both of Ra and PPI below the requirements of the present invention (Nos. 47 to 49) have deteriorated lubricating property. Even if the Ra and PPI are within the range of Example 2 (in the case of No. 50), no improvement of the lubricating property is observed.

EXAMPLE 2

In the present example, the effect of a wax of dispersing type in water, which was added to silicate or silicic acid in Example 1, was examined. Specifically, solutions containing given volumes of a variety of silicate or silicic acid ($SiO_2$ colloidal solution) shown in Table 3 were coated on galvannealed steel sheets of 60 g/m$^2$ deposition, by means of a pinch roll. In the same manner as in Example 1, hard coatings were formed.

The galvanized steel sheets with coatings containing a variety of silicate and silicic acid, produced by such manner, were assessed of their lubricating property and phosphatability. The results are collectively shown in Table 3.

The results in the Table indicate what will be described below.

Nos. 51 to 63 are examples wherein a variety of waxes are added to No. 1 (the inventive example). Because the amounts of the waxes added are within the preferable range defined by the present invention, it has been found that the lubricating property is far improved.

It is indicated that No. 64 and No. 65 with different types of silicate and Nos. 66 to 69 with silicic acid used therein have also very excellent lubricating property.

On the contrary, Nos. 70 and 71, with the wax addition above the preferable upper limit of the present invention, have exceedingly deteriorated lubricating property and phosphatability. Also, Nos. 72 and 73 with the wax addition below the preferable lower limit of the present invention have more or less lower frictional coefficients.

EXAMPLE 3

In the present example, the effect of the coating ratio of the coatings containing silicate or silicic acid on lubricating property and phosphatability was examined.

Solutions containing given volumes of a variety of silicate or silicic acid ($SiO_2$ colloidal solution) shown in Table 4 were coated on galvannealed steel sheets of 60 g/m$^2$ deposition, by means of a pinch roll. The silicate or silicic acid coating ratio after coating and drying is concurrently shown in Table 4. After coating, hard coatings were formed in the same manner as in Example 1.

The galvanized steel sheets with coatings containing a variety of silicate and silicic acid, produced by such manner, were assessed of their lubricating property and phosphatability in the same manner as in Example 1.

TABLE 3

| | Galvannealed steel sheet | | | Silicate or silicic acid | | Wax | | Lubricating property | | |
|---|---|---|---|---|---|---|---|---|---|---|
| No. | Fe (%) | Ra (μm) | PPI | Type | $SiO_2$ deposition (mg/m$^2$) | Type | Amount added (% by weight)*1 | Frictional coefficient | Die scratch resistance | Phosphatibility |
| 51 | 10.0 | 1.0 | 150 | $Na_2O—6SiO_2$ | 20 | paraffin | 1 | 0.09 | ◎ | ○ |
| 52 | 10.0 | 1.0 | 150 | " | 20 | " | 5 | 0.08 | ◎ | ○ |
| 53 | 10.0 | 1.0 | 150 | " | 20 | " | 10 | 0.07 | ◎ | ○ |
| 54 | 10.0 | 1.0 | 150 | " | 20 | " | 30 | 0.07 | ◎ | ○ |
| 55 | 10.0 | 1.0 | 150 | " | 20 | polyethylene oxide | 10 | 0.07 | ◎ | ○ |
| 56 | 10.0 | 1.0 | 150 | " | 20 | low-molecular polyethylene | 10 | 0.07 | ◎ | ○ |
| 57 | 10.0 | 1.0 | 150 | " | 20 | polyolefin | 10 | 0.07 | ◎ | ○ |
| 58 | 10.0 | 1.0 | 150 | " | 20 | carnauba wax | 10 | 0.07 | ◎ | ○ |
| 59 | 10.0 | 1.0 | 150 | " | 20 | ricewax | 10 | 0.07 | ◎ | ○ |
| 60 | 10.0 | 1.0 | 150 | " | 20 | montane wax | 10 | 0.07 | ◎ | ○ |
| 61 | 10.0 | 1.0 | 150 | " | 20 | polypropylene oxide | 10 | 0.07 | ◎ | ○ |
| 62 | 10.0 | 1.0 | 150 | " | 20 | low-molecular polyolefin | 10 | 0.07 | ◎ | ○ |
| 63 | 10.0 | 1.0 | 150 | " | 20 | polypropylene | 10 | 0.07 | ◎ | ○ |
| 64 | 10.0 | 1.0 | 150 | $Li_2O—5SiO_2$ | 20 | paraffin | 10 | 0.07 | ◎ | ○ |
| 65 | 10.0 | 1.0 | 150 | $K_2O—5SiO_2$ | 20 | polyethylene oxide | 10 | 0.07 | ◎ | ○ |
| 66 | 10.0 | 1.0 | 150 | $SiO_2$ | 20 | paraffin | 10 | 0.07 | ◎ | ○ |
| 67 | 10.0 | 1.0 | 150 | " | 20 | " | 10 | 0.07 | ◎ | ○ |
| 68 | 10.0 | 1.0 | 150 | " | 20 | " | 10 | 0.07 | ◎ | ○ |
| 69 | 10.0 | 1.0 | 150 | " | 20 | " | 10 | 0.07 | ◎ | ○ |
| 70 | 10.0 | 1.0 | 150 | $Li_2O—5SiO_2$ | 20 | paraffin | 40 | 0.15 | x | x |
| 71 | 10.0 | 1.0 | 150 | $K_2O—5SiO_2$ | 20 | " | 50 | 0.16 | x | x |
| 72 | 10.0 | 1.0 | 150 | $Na_2O—6SiO_2$ | 20 | " | 0.7 | 0.11 | ○ | ○ |
| 73 | 10.0 | 1.0 | 150 | $Na_2O—6SiO_2$ | 20 | " | 0.3 | 0.11 | ○ | ○ |

*1: % by weight to the $SiO_2$ content after silicate coating

The results are collectively shown in Table 4.

TABLE 4

| | Galvannealed steel sheet | | | Silicate or silicic acid | | Lubricating property | | |
|---|---|---|---|---|---|---|---|---|
| No. | Fe (%) | Ra (μm) | PPI | Type | Coating ratio (%) | Frictional coefficient | Dice scratch resistance | Phosphatability |
| 74 | 10.0 | 1.0 | 150 | $Na_2O—6SiO_2$ | 1 | 0.12 | ◎ | ○ |
| 75 | 10.0 | 1.0 | 150 | " | 5 | 0.11 | ◎ | ○ |
| 76 | 10.0 | 1.0 | 150 | " | 10 | 0.11 | ◎ | ○ |
| 77 | 10.0 | 1.0 | 150 | " | 20 | 0.11 | ◎ | ○ |
| 78 | 10.0 | 1.0 | 150 | " | 40 | 0.10 | ◎ | ○ |
| 79 | 10.0 | 1.0 | 150 | " | 60 | 0.10 | ◎ | ○ |
| 80 | 10.0 | 1.0 | 150 | $Na_2O—5SiO_2$ | 20 | 0.11 | ◎ | ○ |
| 81 | 10.0 | 1.0 | 150 | $Na_2O—3SiO_2$ | 20 | 0.11 | ◎ | ○ |
| 82 | 10.0 | 1.0 | 150 | $Na_2O—7SiO_2$ | 20 | 0.11 | ◎ | ○ |
| 83 | 10.0 | 1.0 | 150 | $Na_2O—8SiO_2$ | 20 | 0.11 | ◎ | ○ |
| 84 | 10.0 | 1.0 | 150 | $Li_2O—3SiO_2$ | 20 | 0.11 | ◎ | ○ |
| 85 | 10.0 | 1.0 | 150 | $Li_2O—5SiO_2$ | 20 | 0.11 | ◎ | ○ |
| 86 | 10.0 | 1.0 | 150 | $Li_2O—6SiO_2$ | 20 | 0.11 | ◎ | ○ |
| 87 | 10.0 | 1.0 | 150 | $Li_2O—8SiO_2$ | 20 | 0.11 | ◎ | ○ |
| 88 | 10.0 | 1.0 | 150 | $K_2O—3SiO_2$ | 20 | 0.11 | ◎ | ○ |
| 89 | 10.0 | 1.0 | 150 | $K_2O—5SiO_2$ | 20 | 0.11 | ◎ | ○ |
| 90 | 10.0 | 1.0 | 150 | $K_2O—6SiO_2$ | 20 | 0.11 | ◎ | ○ |
| 91 | 10.0 | 1.0 | 150 | $K_2O—8SiO_2$ | 20 | 0.11 | ◎ | ○ |
| 92 | 9.0 | 1.0 | 150 | $Na_2O—6SiO_2$ | 20 | 0.11 | ◎ | ○ |
| 93 | 8.0 | 1.0 | 150 | " | 20 | 0.12 | ◎ | ○ |
| 94 | 7.0 | 1.0 | 150 | " | 20 | 0.13 | ◎ | ○ |
| 95 | 10.0 | 0.7 | 150 | " | 20 | 0.11 | ◎ | ○ |
| 96 | 10.0 | 0.9 | 150 | " | 20 | 0.11 | ◎ | ○ |
| 97 | 10.0 | 12 | 150 | " | 20 | 0.11 | ◎ | ○ |
| 98 | 10.0 | 1.4 | 150 | " | 20 | 0.11 | ◎ | ○ |
| 99 | 10.0 | 1.0 | 100 | " | 20 | 0.11 | ◎ | ○ |
| 100 | 10.0 | 1.0 | 130 | " | 20 | 0.11 | ◎ | ○ |
| 101 | 10.0 | 1.0 | 200 | " | 20 | 0.11 | ◎ | ○ |
| 102 | 10.0 | 1.0 | 250 | " | 20 | 0.11 | ◎ | ○ |
| 103 | 10.0 | 1.0 | 150 | $SiO_2$ | 1 | 0.12 | ◎ | ○ |
| 104 | 10.0 | 1.0 | 150 | " | 5 | 0.11 | ◎ | ○ |
| 105 | 10.0 | 1.0 | 150 | " | 10 | 0.11 | ◎ | ○ |
| 106 | 10.0 | 1.0 | 150 | " | 20 | 0.11 | ◎ | ○ |
| 107 | 10.0 | 1.0 | 150 | $Na_2O—2SiO_2$ | 20 | 0.13 | ◎ | ○ |
| 108 | 10.0 | 1.0 | 150 | $Na_2O—9SiO_2$ | 20 | 0.11 | ○ | ○ |
| 109 | 6.8 | 1.0 | 150 | $Na_2O—6SiO_2$ | 20 | 0.13 | ◎ | ○ |
| 110 | 15.0 | 1.0 | 150 | $Na_2O—6SiO_2$ | 20 | 0.11 | ◎ | ○ |
| 111 | 10.0 | 0.5 | 150 | $SiO_2$ | 20 | 0.11 | ◎ | ○ |
| 112 | 10.0 | 1.0 | 75 | " | 20 | 0.11 | ◎ | ○ |
| 113 | 10.0 | 1.0 | 150 | — | — | 0.16 | x | ○ |
| 114 | 10.0 | 1.0 | 150 | $Na_2O—6SiO_2$ | 0.5 | 0.16 | Δ | ○ |
| 115 | 10.0 | 1.0 | 150 | " | 70 | 0.10 | ○ | x |
| 116 | 10.0 | 0.4 | 150 | " | 20 | 0.14 | x | ○ |
| 117 | 10.0 | 1.0 | 70 | " | 20 | 0.16 | x | ○ |

The results in the Table indicate what is described now.

Nos. 74 to 112 are galvanized steel sheets satisfying all the requirements of the present invention, with excellent lubricating property and phosphatability.

On the contrary, Nos. 113 to 117 which cannot satisfy one of the requirements of the present invention have the following disadvantages.

No. 113 has a larger frictional coefficient along with poor dice scratch resistance, because the sample does not have any coating containing silicate. Overall, the lubricating property is totally bad.

No. 114 is an example outside the lower limit of the coating ratio of the coating, defined by the present invention, which has a larger frictional coefficient and slightly poor dice scratch resistance.

No. 115 is an example with the coating ratio above the upper limit defined by the present invention, which has a smaller frictional coefficient and good dice scratch resistance. However, the phosphatability is deteriorated.

Nos. 116 and 117 are examples with the surface roughness of the plated steel sheets below the requirements of the present invention, both of which have excellent phosphatability but poor lubricating property.

EXAMPLE 4

In the present example, the effect of a wax of dispersing type in water, which is added to silicate or silicic acid in Example 3, was examined. Specifically, solutions containing given volumes of a variety of silicate or silicic acid ($SiO_2$ colloidal solution) shown in Table 5 were coated on galvannealed steel sheets of 60 g/m$^2$ deposition, by means of a pinch roll. In the same manner as in Example 1, hard coatings were formed.

The galvanized steel sheets with coatings containing a variety of silicate and silicic acid, produced by such manner, were assessed of their lubricating property and phosphatability. The results are collectively shown in Table 5.

TABLE 5

| | Galvannealed steel sheet | | | Silicate or silicic acid | | Wax | | Lubricating property | | |
|---|---|---|---|---|---|---|---|---|---|---|
| | | | | | $SiO_2$ deposition | | Amount added | Frictional | Die scratch | |
| No. | Fe (%) | Ra (μm) | PPI | Type | (mg/m$^2$) | Type | (% by weight)*1 | coefficient | resistance | Phosphatability |
| 118 | 10.0 | 1.0 | 150 | $Na_2O—6SiO_2$ | 20 | paraffin | 1 | 0.09 | ⊚ | ○ |
| 119 | 10.0 | 1.0 | 150 | " | 20 | " | 5 | 0.08 | ⊚ | ○ |
| 120 | 10.0 | 1.0 | 150 | " | 20 | " | 10 | 0.07 | ⊚ | ○ |
| 121 | 10.0 | 1.0 | 150 | " | 20 | " | 30 | 0.07 | ⊚ | ○ |
| 122 | 10.0 | 1.0 | 150 | " | 20 | polyethylene oxide | 10 | 0.07 | ⊚ | ○ |
| 123 | 10.0 | 1.0 | 150 | " | 20 | low-molecular polyethylene | 10 | 0.07 | ⊚ | ○ |
| 124 | 10.0 | 1.0 | 150 | " | 20 | polyolefin | 10 | 0.07 | ⊚ | ○ |
| 125 | 10.0 | 1.0 | 150 | " | 20 | carnauba wax | 10 | 0.07 | ⊚ | ○ |
| 126 | 10.0 | 1.0 | 150 | " | 20 | rice wax | 10 | 0.07 | ⊚ | ○ |
| 127 | 10.0 | 1.0 | 150 | " | 20 | montane wax | 10 | 0.07 | ⊚ | ○ |
| 128 | 10.0 | 1.0 | 150 | " | 20 | polypropylene oxide | 10 | 0.07 | ⊚ | ○ |
| 129 | 10.0 | 1.0 | 150 | " | 20 | low-molecular polyolefin | 10 | 0.07 | ⊚ | ○ |
| 130 | 10.0 | 1.0 | 150 | " | 20 | polypropylene | 10 | 0.07 | ⊚ | ○ |
| 131 | 10.0 | 1.0 | 150 | $Li_2O—5SiO_2$ | 20 | paraffin | 10 | 0.07 | ⊚ | ○ |
| 132 | 10.0 | 1.0 | 150 | $K_2O—5SiO_2$ | 20 | polyethylene oxide | 10 | 0.07 | ⊚ | ○ |
| 133 | 10.0 | 1.0 | 150 | $SiO_2$ | 20 | paraffin | 1 | 0.09 | ⊚ | ○ |
| 134 | 10.0 | 1.0 | 150 | " | 20 | " | 5 | 0.08 | ⊚ | ○ |
| 135 | 10.0 | 1.0 | 150 | " | 20 | " | 10 | 0.07 | ⊚ | ○ |
| 136 | 10.0 | 1.0 | 150 | " | 20 | " | 30 | 0.07 | ⊚ | ○ |
| 137 | 10.0 | 1.0 | 150 | $Li_2O—5SiO_2$ | 20 | paraffin | 40 | 0.15 | x | x |
| 138 | 10.0 | 1.0 | 150 | $K_2O—5SiO_2$ | 20 | " | 50 | 0.16 | x | x |
| 139 | 10.0 | 1.0 | 150 | $Na_2O—6SiO_2$ | 20 | " | 0.7 | 0.11 | ○ | ○ |
| 140 | 10.0 | 1.0 | 150 | $Na_2O—6SiO_2$ | 20 | " | 0.3 | 0.11 | ○ | ○ |

*2: % by weight to the $SiO_2$ content after silicate coating

The results of the Table indicate what will be described below.

Nos. 118 to 130 are examples wherein a variety of waxes are added to No. 77 (the inventive example). Because the amounts of the waxes added are within the preferable range defined by the present invention, it has been found that the lubricating property is far improved than that of No. 77.

It is indicated that No. 131 and No. 132 with different types of silicate and Nos. 133 to 136 with silicic acid used therein have very excellent lubricating property.

On the contrary, Nos. 137 and 138 with the wax addition above the preferable upper limit of the present invention have exceedingly deteriorated lubricating property and phosphatability. Also, Nos. 139 and 140 with the wax addition below the preferable lower limit of the present invention have more or less lower frictional coefficients.

EXAMPLE 5

In the present Example, the effects of silicic acid deposition or silicate deposition and the ratio B/A wherein A is the $SiO_2$ deposition on protrusion parts and B is the $SiO_2$ deposition on recess parts, on lubricating property, adhesion with adhesive in oil and phosphatability, were examined.

Solutions containing given volumes of silicic acid ($SiO_2$ colloidal solution) or silicate shown in Tables 6 to 8 were coated on galvannealed steel sheets by means of a pinch roll. After coating, the sheets were dried at 80° C., to form hard $SiO_2$ coatings. The dried $SiO_2$ weight after coating and drying and the ratio B/A of the $SiO_2$ deposition B on the recess parts to the $SiO_2$ deposition A on the protrusion parts of the galvanized steel sheets are collectively shown in Tables 6 to 8.

The galvanized steel sheets coated with silicic acid (silicate), produced by such manner, were assessed of their lubricating property (frictional coefficient), adhesion with adhesive in oil (T peel strength) and phosphatability in the same manner as those of the experimental methods for FIGS. 5 and 6. The results are collectively shown in Tables 6 to 8.

TABLE 6

| | Galvannealed steel sheet | | | Silicate or silicic acid | | | | | Lubricating property | Adhesion with adhesive in oil | |
|---|---|---|---|---|---|---|---|---|---|---|---|
| | | | | | $SiO_2$ deposition | | | Oil viscosity | Frictional | T peel strength | |
| No. | Fe (%) | Ra (μm) | PPI | Type | (mg/m$^2$) | B/A | r value | (mm$^2$/s at 40° C.) | coefficient | (kgf/25 mm) | Phosphatability |
| 1 | 10.0 | 1.0 | 150 | silicic acid | 1 | 2.0 | 1.70 | 17.4 | 0.13 | 12.5 | ○ |
| 2 | " | " | " | " | 5 | " | " | " | 0.12 | 12.1 | ○ |
| 3 | " | " | " | " | 10 | " | " | " | 0.11 | 11.8 | ○ |

TABLE 6-continued

| No. | Galvannealed steel sheet Fe (%) | Ra (μm) | PPI | Silicate or silicic acid Type | $SiO_2$ deposition (mg/m$^2$) | B/A | r value | Oil viscosity (mm$^2$/s at 40° C.) | Lubricating property Frictional coefficient | Adhesion with adhesive in oil T peel strength (kgf/25 mm) | Phosphatability |
|---|---|---|---|---|---|---|---|---|---|---|---|
| 4 | " | " | " | " | 20 | " | " | " | " | 11.5 | ○ |
| 5 | " | " | " | " | 50 | " | " | " | " | " | ○ |
| 6 | " | " | " | " | 100 | " | " | " | " | " | ○ |
| 7 | " | " | " | " | 200 | " | " | " | " | 11.0 | ○ |
| 8 | " | " | " | " | 20 | 1.2 | " | " | " | " | ○ |
| 9 | " | " | " | " | " | 1.5 | " | " | " | 11.2 | |
| 10 | " | " | " | " | " | 1.7 | " | " | " | 1.13 | ○ |
| 11 | " | " | " | " | " | 2.5 | " | " | " | 12.0 | ○ |
| 12 | " | " | " | " | " | 3.0 | " | " | " | 12.2 | ○ |
| 13 | " | " | " | " | " | 5.0 | " | " | " | 12.3 | ○ |
| 14 | " | " | " | " | " | 10.0 | " | " | " | 12.4 | ○ |
| 15 | " | " | " | " | " | 20.0 | " | " | " | " | ○ |
| 16 | " | " | " | " | " | 50.0 | " | " | " | " | ○ |
| 17 | " | " | " | " | " | 100.0 | " | " | " | " | ○ |
| 18 | 9.0 | " | " | " | " | 2.0 | " | " | " | 11.5 | ○ |
| 19 | 7.0 | " | " | " | " | " | " | " | 0.12 | " | ○ |
| 20 | 6.0 | " | " | " | " | " | " | " | 0.13 | " | ○ |
| 21 | 11.0 | " | " | " | " | " | " | " | 0.11 | " | ○ |
| 22 | 13.0 | " | " | " | " | " | " | " | " | " | ○ |
| 23 | 15.0 | " | " | " | ". | " | " | " | " | " | ○ |
| 24 | 16.0 | " | " | " | " | " | " | " | " | " | ○ |
| 25 | 10.0 | 0.9 | " | " | " | " | " | " | " | " | ○ |
| 26 | " | 0.7 | " | " | " | " | " | " | " | " | ○ |
| 27 | " | 0.5 | " | " | " | " | " | " | 0.12 | " | ○ |
| 28 | " | 0.4 | " | " | " | " | " | " | 0.13 | " | ○ |
| 29 | " | 1.1 | " | " | " | " | " | " | 0.11 | " | ○ |
| 30 | " | 1.3 | " | " | " | " | " | " | " | " | ○ |

TABLE 7

| No. | Galvannealed steel sheet Fe (%) | Ra (μm) | PPI | Silicate or silicic acid Type | $SiO_2$ deposition (mg/m$^2$) | B/A | r value | Oil viscosity (mm$^2$/s at 40° C.) | Lubricating property Frictional coefficient | Adhesion with adhesive in oil T peel strength (kgf/25 mm) | Phosphatability |
|---|---|---|---|---|---|---|---|---|---|---|---|
| 31 | 10.0 | 1.5 | 150 | silicic acid | 20 | 2.0 | 1.70 | 17.4 | 0.12 | 11.5 | ○ |
| 32 | " | 1.6 | " | " | " | " | " | " | 0.13 | " | ○ |
| 33 | " | 1.0 | 120 | " | " | " | " | " | 0.11 | " | ○ |
| 34 | " | " | 100 | " | " | " | " | " | " | " | ○ |
| 35 | " | " | 75 | " | " | " | " | " | " | " | ○ |
| 36 | " | " | 60 | " | " | " | " | " | " | " | ○ |
| 37 | " | " | 200 | " | " | " | " | " | " | " | ○ |
| 38 | " | " | 250 | " | " | " | " | " | " | " | ○ |
| 39 | " | " | 300 | " | " | " | " | " | 0.12 | " | ○ |
| 40 | " | " | 350 | " | " | " | " | " | 0.13 | " | ○ |
| 41 | " | " | 150 | Na silicate | " | " | " | " | 0.11 | " | ○ |
| 42 | " | " | " | " | " | 1.2 | " | " | " | 11.0 | ○ |
| 43 | " | " | " | " | " | 5.0 | " | " | " | 12.0 | ○ |
| 44 | " | " | " | K silicate | " | 2.0 | " | " | " | 11.5 | ○ |
| 45 | " | " | " | Li silicate | " | " | " | " | " | " | ○ |
| 46 | " | " | " | silicic acid | " | " | " | 30.0 | " | 11.3 | ○ |
| 47 | " | " | " | " | " | " | " | 40.0 | " | 11.2 | ○ |
| 48 | " | " | " | " | " | " | " | 50.0 | " | 11.1 | ○ |
| 49 | " | " | " | " | ." | " | " | 60.0 | " | 11.0 | Δ |
| 50 | " | " | " | " | " | " | " | 10.0 | " | 11.5 | ○ |
| 51 | " | " | " | " | " | " | " | 5.0 | 0.12 | " | ○ |
| 52 | " | " | " | " | " | " | " | 3.0 | 0.13 | " | ○ |
| 53 | " | " | " | " | " | " | 1.50 | 17.4 | 0.11 | " | ○ |
| 54 | " | " | " | " | " | " | 1.40 | " | " | " | ○ |
| 55 | " | " | " | " | " | " | 1.30 | " | " | " | ○ |
| 56 | " | " | " | " | " | " | 2.0 | " | " | " | ○ |
| 57 | " | " | " | " | " | " | 2.4 | " | " | " | ○ |

TABLE 8

| No. | Galvannealed steel sheet Fe (%) | Ra (μm) | PPI | Silicate or silicic acid Type | $SiO_2$ deposition (mg/m²) | B/A | r value | Oil viscosity (mm²/s at 40° C.) | Lubricating property Frictional coefficient | Adhesion with adhesive in oil T peel strength (kgf/25 mm) | Phosphatability |
|---|---|---|---|---|---|---|---|---|---|---|---|
| 58 | 10.0 | 1.0 | 150 | — | 0 | — | 1.70 | 17.4 | 0.18 | 12.5 | ○ |
| 59 | " | " | " | silicic acid | 0.1 | 1.5 | " | " | 0.17 | " | ○ |
| 60 | " | " | " | " | 0.5 | 2.0 | " | " | 0.16 | 11.9 | ○ |
| 61 | " | " | " | " | 0.8 | " | " | " | " | 11.8 | ○ |
| 62 | " | " | " | Na silicate | " | " | " | " | " | 11.5 | ○ |
| 63 | " | " | " | silicic acid | 20 | 1.1 | " | " | 0.11 | 6.0 | x |
| 64 | " | " | " | " | " | 1.0 | " | " | " | 4.0 | x |
| 65 | " | " | " | " | " | 0.8 | " | " | " | " | x |
| 66 | " | " | " | " | " | 0.5 | " | " | " | " | x |
| 67 | " | " | " | " | " | 0.3 | " | " | " | " | x |
| 68 | " | " | " | Na silicate | " | " | " | " | " | " | x |
| 69 | " | " | " | silicic acid | 300 | 2.0 | " | " | " | 6.0 | x |

Nos. 1 to 57 are the inventive examples, having excellent lubricating property, adhesion with adhesive in oil and phosphatability. On the contrary, Nos. 58 to 62 are comparative examples with too lower $SiO_2$ weights, which have poor lubricating property. Nos. 63 to 65 are examples with smaller B/A ratios, which are indicated to have both poor adhesion with adhesive in oil and phosphatability. No. 69 is a comparative example with too greater $SiO_2$ weight, and additionally with deteriorated adhesion with adhesive in oil and phosphatability.

EXAMPLE 6

In the present example, the same examination was carried out as in Example 5, while using a variety of steel sheets and plated steel sheets.

Solutions containing given volumes of silicic acid (silicate) were coated on a variety of steel sheets shown in Tables 9 and 10. After coating, the sheets were dried at 80° C., to form hard $SiO_2$ coatings. The dried $SiO_2$ weight after coating and drying and the ratio B/A of the $SiO_2$ deposition B on the recess parts to the $SiO_2$ deposition A on the protrusion parts of the steel sheets are collectively shown in Tables 9 and 10.

The steel sheets coated with silicic acid (silicate), produced by such manner, were assessed of their lubricating property (frictional resistance), adhesion with adhesive in oil (T peel strength) and phosphatability. The results are collectively shown in Tables 9 to 10.

TABLE 9

| No. | Steel plate or plated steel plate | Silicate or silicic acid Type | $SiO_2$ deposition (mg/m²) | B/A | r value | Oil viscosity (mm²/s at 40° C.) | Lubricating property Frictional coefficient | Adhesion with adhesive in oil T peel strength (kgf/25 mm) | Phosphatability |
|---|---|---|---|---|---|---|---|---|---|
| 70 | Electrogalvanization | silicic acid | 1 | 2.0 | 1.65 | 17.4 | 0.15 | 12.5 | ○ |
| 71 | " | " | 5 | " | " | " | 0.14 | 12.3 | ○ |
| 72 | " | " | 10 | " | " | " | 0.13 | 12.0 | ○ |
| 73 | " | " | 20 | " | " | " | 0.12 | 11.5 | ○ |
| 74 | " | " | 50 | " | " | " | " | " | ○ |
| 75 | " | " | 100 | " | " | " | " | " | ○ |
| 76 | " | " | 200 | " | " | " | " | " | ○ |
| 77 | " | " | 20 | 1.2 | " | " | " | 11.0 | ○ |
| 78 | " | " | " | 1.5 | " | " | " | 11.3 | ○ |
| 79 | " | " | " | 2.5 | " | " | " | 12.5 | ○ |
| 80 | " | " | " | 3.0 | " | " | " | " | ○ |
| 81 | " | " | " | 5.0 | " | " | " | " | ○ |
| 82 | " | " | " | 10.0 | " | " | " | " | ○ |
| 83 | " | " | " | 30.0 | " | " | " | " | ○ |
| 84 | " | " | " | 100 | " | " | " | " | ○ |
| 85 | " | Na silicate | 10 | 2.0 | " | " | " | " | ○ |
| 86 | " | " | 20 | " | " | " | " | " | ○ |
| 87 | " | " | 30 | " | " | " | " | " | ○ |
| 88 | " | K silicate | 20 | " | " | " | " | " | ○ |
| 89 | " | Li silicate | " | " | " | " | " | " | ○ |
| 90 | Electrodeposition with Zn—15Fe alloy | silicic acid | " | " | " | " | 0.09 | 11.5 | ○ |
| 91 | Electrodeposition with Zn—12Ni alloy | " | " | " | " | " | " | " | ○ |
| 92 | Electrodeposition with Zn—15Cr alloy | " | " | " | " | " | " | " | ○ |
| 93 | Hot-dip Zn deposition | " | " | " | " | " | 0.12 | " | ○ |
| 94 | Hot-dip Al deposition | " | " | " | " | " | " | " | ○ |
| 95 | Cold-rolled steel plate | " | " | " | " | " | 0.09 | 12.0 | ○ |

TABLE 10

| No. | Steel plate or plated steel plate | Silicate or silicic acid: Type | Silicate or silicic acid: $SiO_2$ deposition ($mg/m^2$) | Silicate or silicic acid: B/A | r value | Oil viscosity ($mm^2/s$ at 40° C.) | Lubricating property Frictional coefficient | Adhesion with adhesive in oil T peel strength (kgf/25 mm) | Phosphatability |
|---|---|---|---|---|---|---|---|---|---|
| 96 | Electrogalvanization | silicic acid | — | — | 1.65 | 17.4 | 0.18 | 12.5 | ○ |
| 97 | " | " | 0.1 | 2.0 | " | " | 0.17 | 12.3 | ○ |
| 98 | " | " | 0.3 | " | " | " | " | 12.0 | ○ |
| 99 | " | " | 0.5 | " | " | " | " | 11.5 | ○ |
| 100 | " | " | 0.8 | " | " | " | 0.16 | 12.5 | ○ |
| 101 | " | " | 20 | 1.1 | " | " | 0.12 | 7.0 | x |
| 102 | " | " | " | 1.0 | " | " | " | 5.0 | x |
| 103 | " | " | " | 0.9 | " | " | " | 4.5 | x |
| 104 | " | " | " | 0.7 | " | " | " | 4.0 | x |
| 105 | " | " | " | 0.5 | " | " | " | " | x |
| 106 | Electrodeposition with Zn—12Ni alloy | " | " | 1 .0 | " | " | 0.09 | " | x |
| 107 | " | " | " | " | " | " | " | " | x |
| 108 | Hot-dip Zn deposition | " | — | — | " | " | 0.18 | 12.5 | ○ |
| 109 | " | " | 0.5 | 2.0 | " | ." | 0.17 | 11.5 | ○ |
| 110 | " | " | 20 | 1.0 | " | " | 0.12 | 4.0 | x |

Nos. 70 to 95 are the inventive examples, having excellent lubricating property, adhesion with adhesive in oil and phosphatability. On the contrary, Nos. 96 to 100 and Nos. 108 and 109 are comparative examples with no $SiO_2$ coating or too lower $SiO_2$ weights, which have poor lubricating property. Nos. 101 to 107 and No. 110 are examples with smaller B/A ratios, which are indicated to have both poor adhesion with adhesive in oil and phosphatability.

EXAMPLE 7

In the present example, the effect of $SiO_2$ deposition and the alkali concentration ratio on the lubricating property, adhesion with adhesive in oil and phosphatability were assessed, using a variety of steel sheets.

Solutions containing given volumes of silicic acid (silicate) were coated on a variety of steel sheets shown in Tables 11 to 13. After coating, the sheets were dried at 80° C., to form hard $SiO_2$ coatings. The dried $SiO_2$ weight after coating and drying, and the percentage by weight of $(Na_2O+K_2O+Li_2O)/SiO_2$ in the $SiO_2$ coatings, are collectively shown in Tables 11 to 13.

The steel sheets coated with silicic acid (silicate), produced by such manner, were assessed of their lubricating property (frictional coefficient), adhesion with adhesive in oil (T peel strength) and phosphatability. The results are collectively shown in Tables 11 to 13.

TABLE 11

| No. | Steel plate or plated steel plate | Silicate or silicic acid: Type | Silicate or silicic acid: $SiO_2$ deposition ($mg/m^2$) | Silicate or silicic acid: Alkali concentration ratio (%)*1 | Silicate or silicic acid: Additive Type | Silicate or silicic acid: Additive Deposition ($mg/m^2$) | r value | Oil viscosity ($mm^2/s$ at 40° C.) | Lubricating property Frictional coefficient | Adhesion with adhesive in oil T peel strength (kgf/25 mm) | Phosphatability |
|---|---|---|---|---|---|---|---|---|---|---|---|
| 111 | Galvannealed steel sheet | silicic acid | 1 | 0.15 | — | — | 1.70 | 17.4 | 0.13 | 12.5 | ○ |
| 112 | Galvannealed steel sheet | " | 5 | " | — | — | " | " | 0.12 | 12.1 | ○ |
| 113 | Galvannealed steel sheet | " | 10 | " | — | — | " | " | 0.11 | 11.8 | ○ |
| 114 | Galvannealed steel sheet | " | 20 | " | — | — | " | " | " | 11.5 | ○ |
| 115 | Galvannealed steel sheet | " | 50 | " | — | — | " | " | " | 11.5 | ○ |
| 116 | Galvannealed steel sheet | " | 100 | " | — | — | " | " | " | 11.5 | ○ |
| 117 | Galvannealed steel sheet | " | 200 | " | — | — | " | " | " | 11.0 | ○ |
| 118 | Galvannealed steel sheet | " | 20 | 0.01 | — | — | " | " | " | 11.8 | ○ |
| 119 | Galvannealed steel sheet | " | " | 0.03 | — | — | " | " | " | 11.7 | ○ |
| 120 | Galvannealed steel sheet | " | " | 0.05 | — | — | " | " | " | 11.7 | ○ |
| 121 | Galvannealed steel sheet | " | " | 0.07 | — | — | " | " | " | 11.7 | ○ |
| 122 | Galvannealed steel sheet | " | " | 0.10 | — | — | " | " | " | 11.6 | ○ |

TABLE 11-continued

| No. | Steel plate or plated steel plate | Silicate or silicic acid: Type | $SiO_2$ deposition ($mg/m^2$) | Alkali concentration ratio (%)*1 | Additive: Type | Additive: Deposition ($mg/m^2$) | r value | Oil viscosity ($mm^2/s$ at 40° C.) | Lubricating property: Frictional coefficient | Adhesion with adhesive in oil: T peel strength (kgf/25 mm) | Phosphatability |
|---|---|---|---|---|---|---|---|---|---|---|---|
| 123 | Galvannealed steel sheet | " | " | 0.30 | — | — | " | " | " | 11.5 | ○ |
| 124 | Galvannealed steel sheet | " | " | 0.50 | — | — | " | " | " | 11.5 | ○ |
| 125 | Galvannealed steel sheet | " | " | 0.70 | — | — | " | " | " | 11.5 | ○ |
| 126 | Galvannealed steel sheet | " | " | 1.00 | — | — | " | " | " | 11.4 | ○ |
| 127 | Galvannealed steel sheet | " | " | 2.00 | — | — | " | " | " | 11.3 | ○ |
| 128 | Galvannealed steel sheet | " | " | 3.00 | — | — | " | " | " | 11.1 | ○ |
| 129 | Galvannealed steel sheet | Na silicate | " | 0.15 | — | — | " | " | " | 11.5 | ○ |
| 130 | Galvannealed steel sheet | " | " | 0.50 | — | — | " | " | " | 11.5 | ○ |
| 131 | Galvannealed steel sheet | " | " | 2.00 | — | — | " | " | " | 11.5 | ○ |
| 132 | Galvannealed steel sheet | K silicate | " | 0.15 | — | — | " | " | " | 11.5 | ○ |
| 133 | Galvannealed steel sheet | Li silicate | " | " | — | — | " | " | " | 11.5 | ○ |
| 134 | Galvannealed steel sheet | silicic acid | " | " | Zn oxide | 1 | " | " | " | 11.3 | ○ |
| 135 | Galvannealed steel sheet | " | " | " | Zn oxide | 10 | " | " | 0.10 | 11.3 | ○ |
| 136 | Galvannealed steel sheet | " | " | " | Zn oxide | 50 | " | " | 0.10 | 11.3 | ○ |
| 137 | Galvannealed steel sheet | " | " | " | Zn oxide | 100 | " | " | 0.10 | 11.3 | ○ |

TABLE 12

| No. | Steel plate or plated steel plate | Silicate or silicic acid: Type | $SiO_2$ deposition ($mg/m^2$) | Alkali concentration ratio (%)*1 | Additive: Type | Additive: Deposition ($mg/m^2$) | r value | Oil viscosity ($mm^2/s$ at 40° C.) | Lubricating property: Frictional coefficient | Adhesion with adhesive in oil: T peel strength (kgf/25 mm) | Phosphatability |
|---|---|---|---|---|---|---|---|---|---|---|---|
| 138 | Galvannealed steel sheet | silicic acid | 20 | 0.15 | Ni oxide | 10 | 1.70 | 17.4 | 0.10 | 11.3 | ○ |
| 139 | Galvannealed steel sheet | " | " | " | Fe oxide | " | " | " | " | " | ○ |
| 140 | Galvannealed steel sheet | " | " | " | Co oxide | " | " | " | " | " | ○ |
| 141 | Galvannealed steel sheet | " | " | " | Mo oxide | " | " | " | " | " | ○ |
| 142 | Galvannealed steel sheet | " | " | " | W oxide | " | " | " | " | " | ○ |
| 143 | Galvannealed steel sheet | " | " | " | V oxide | " | " | " | " | " | ○ |
| 144 | Galvannealed steel sheet | " | " | " | $PO_4$ | " | " | " | " | " | ○ |
| 145 | Galvannealed steel sheet | " | " | " | $PO_3$ | " | " | " | " | " | ○ |
| 146 | cold-rolled steel sheet | " | " | " | — | — | " | " | 0.09 | 11.5 | ○ |
| 147 | cold-rolled steel sheet | Na silicate | " | 3.00 | — | — | " | " | 0.09 | 11.0 | ○ |
| 148 | cold-rolled steel sheet | K silicate | " | 3.00 | — | — | " | " | 0.09 | 11.0 | ○ |
| 149 | cold-rolled steel sheet | Li silicate | " | 3.00 | — | — | " | " | 0.09 | 11.0 | ○ |
| 150 | Zn electrodeposition | silicic acid | " | 0.15 | — | — | " | " | 0.14 | 11.5 | ○ |
| 151 | Zn electrodisposition | Na silicate | " | 3.00 | — | — | " | " | 0.14 | 11.0 | ○ |

TABLE 12-continued

| No. | Steel plate or plated steel plate | Silicate or silicic acid Type | $SiO_2$ deposition ($mg/m^2$) | Alkali concentration ratio (%)*1 | Additive Type | Additive Deposition ($mg/m^2$) | r value | Oil viscosity ($mm^2/s$ at 40° C.) | Lubricating property Frictional coefficient | Adhesion with adhesive in oil T peel strength (kgf/25 mm) | Phosphatability |
|---|---|---|---|---|---|---|---|---|---|---|---|
| 152 | Zn electrodisposition | K silicate | " | 3.00 | — | — | " | " | 0.14 | 11.0 | ○ |
| 153 | Zn electrodisposition | Li silicate | " | 3.00 | — | — | " | " | 0.14 | 11.0 | ○ |
| 154 | Hot-dip galvanization | silicic acid | " | 0.15 | — | — | " | " | 0.13 | 11.5 | ○ |
| 155 | Hot-dip galvanization | Na silicate | " | 3.00 | — | — | " | " | 0.13 | 11.0 | ○ |
| 156 | Hot-dip galvanization | K silicate | " | 3.00 | — | — | " | " | 0.13 | 11.0 | ○ |
| 157 | Hot-dip galvanization | Li silicate | " | 3.00 | — | — | " | " | 0.13 | 11.0 | ○ |
| 158 | Electrodeposition with Z—Fe alloy | silicic acid | " | 0.15 | — | — | " | " | 0.11 | 11.5 | ○ |
| 159 | Electrodeposition with Z—Fe alloy | Na silicate | " | 3.00 | — | — | " | " | " | 11.0 | ○ |
| 160 | Electrodeposition with Z—Fe alloy | K silicate | " | 3.00 | — | — | " | " | " | 11.0 | ○ |
| 161 | Electrodeposition with Z—Fe alloy | Li silicate | " | 3.00 | — | 1 | " | " | " | 11.0 | ○ |
| 162 | Electrodeposition with Zn—Ni alloy | silicic acid | " | 0.15 | — | 10 | " | " | 0.10 | 11.5 | ○ |
| 163 | Electrodeposition with Zn—Ni alloy | Nasilicate | " | 3.00 | — | 50 | " | " | 0.10 | 11.0 | ○ |
| 164 | Electrodeposition with Zn—Ni alloy | K silicate | " | 3.00 | — | 100 | " | " | 0.10 | 11.0 | ○ |
| 165 | Electrodeposition with Zn—Ni alloy | Li silicate | " | 3.00 | — | 100 | " | " | 0.10 | 11.0 | ○ |

TABLE 13

| No. | Steel plate or plated steel plate | Silicate or silicic acid Type | $SiO_2$ deposition ($mg/m^2$) | Alkali concentration ratio (%)*1 | Additive Type | Additive Deposition ($mg/m^2$) | r value | Oil viscosity ($mm^2/s$ at 40° C.) | Lubricating property Frictional coefficient | Adhesion with adhesive in oil T peel strength (kgf/25 mm) | Phosphatablity |
|---|---|---|---|---|---|---|---|---|---|---|---|
| 166 | Galvannealed steel sheet | silicic acid | 20 | 0.15 | — | — | 1.50 | 17.4 | 0.11 | 11.5 | ○ |
| 167 | Galvannealed steel sheet | " | 20 | " | — | — | 1.40 | " | " | " | ○ |
| 168 | Galvannealed steel sheet | " | 20 | " | — | — | 1.30 | " | " | " | ○ |
| 169 | Galvannealed steel sheet | " | 20 | " | — | — | 2.00 | " | " | " | ○ |
| 170 | Galvannealed steel sheet | " | 20 | " | — | — | 2.30 | " | " | " | ○ |
| 171 | Galvannealed steel sheet | " | 20 | " | — | — | 1.70 | 30.0 | " | " | ○ |
| 172 | Galvannealed steel sheet | " | 20 | " | — | — | " | 40.0 | " | " | ○ |
| 173 | Galvannealed steel sheet | " | 20 | " | — | — | " | 50.0 | 0.10 | " | ○ |
| 174 | Galvannealed steel sheet | " | 20 | " | — | — | " | 60.0 | 0.10 | " | Δ |
| 175 | Galvannealed steel sheet | " | 20 | " | — | — | " | 10.0 | 0.11 | " | ○ |
| 176 | Galvannealed steel sheet | " | 20 | " | — | — | " | 5.0 | 0.11 | " | ○ |
| 177 | Galvannealed steel sheet | " | 20 | " | — | — | " | 3.0 | 0.11 | " | ○ |
| 178 | Galvannealed steel sheet | " | 0 | " | — | — | " | 17.4 | 0.18 | 12.5 | ○ |
| 179 | Galvannealed steel sheet | " | 0.1 | " | — | — | " | " | 0.18 | " | ○ |
| 180 | Galvannealed steel sheet | " | 0.5 | " | — | — | " | " | 0.18 | " | ○ |

TABLE 13-continued

| No. | Steel plate or plated steel plate | Silicate or silicic acid: Type | $SiO_2$ deposition ($mg/m^2$) | Alkali concentration ratio (%)*1 | Additive: Type | Additive: Deposition ($mg/m^2$) | r value | Oil viscosity ($mm^2/s$ at 40° C.) | Lubricating property: Frictional coefficient | Adhesion with adhesive in oil: T peel strength (kgf/25 mm) | Phosphatablity |
|---|---|---|---|---|---|---|---|---|---|---|---|
| 181 | Galvannealed steel sheet | " | 0.7 | " | — | — | " | " | 0.17 | " | ○ |
| 182 | Galvannealed steel sheet | " | 0.9 | " | — | — | " | " | 0.15 | " | ○ |
| 183 | Galvannealed steel sheet | " | 300 | " | — | — | " | " | 0.11 | 6.0 | x |
| 184 | Galvannealed steel sheet | " | 20 | " | — | — | " | " | " | 4.0 | x |
| 185 | Galvannealed steel sheet | " | 20 | 4.00 | — | — | " | " | " | 6.0 | x |
| 186 | Galvannealed steel sheet | " | 20 | 5.00 | — | — | " | " | " | 5.0 | x |
| 187 | Galvannealed steel sheet | " | 20 | 8.00 | — | — | " | " | " | 4.0 | x |
| 188 | Galvannealed steel sheet | " | 20 | 10.00 | — | — | " | " | " | 4.0 | x |
| 189 | Galvannealed steel sheet | " | 20 | 15.00 | — | — | " | " | " | 4.0 | x |

*1: weight ratio of $(Na_2O + Li_2O + K_2O)/SiO_2$

Nos. 111 to 177 are the inventive examples, being excellent in terms of all of lubricating property, adhesion with adhesive in oil and phosphatability. On the contrary, Nos. 178 to 182 are comparative examples with no $SiO_2$ coating or too lower $SiO_2$ weights, which have poor lubricating property. Nos. 183 and 184 are examples with too much $SiO_2$ weights, both of which also have poor adhesion with adhesive in oil along with poor phosphatability. Nos. 185 to 189 are examples with too larger alkali concentration ratios, both of which have poor adhesion with adhesive in oil and poor phosphatability.

EXAMPLE 8

In the present example, the effect of $SiO_2$ content and $SiO_2$ particle size on the lubricating property, adhesion with adhesive in oil and phosphatability were assessed, using a variety of steel sheets.

Solutions containing given volumes of silicic acid ($SiO_2$ colloidal solution) of spherical $SiO_2$ particles were coated on a variety of galvanized steel sheets shown in Tables 14 and 15, by means of a pinch roll. After coating, the sheets were dried to form hard $SiO_2$ coatings containing silicic acid or silicate.

The galvanized steel sheets thus produced were similarly assessed of their lubricating property, adhesion with adhesive in oil and phosphatability. The results are collectively shown in Tables 14 and 15, together with the production conditions. The examples Nos. 1 to 43) satisfying all the requirements defined by the present invention are indicated to have excellent lubricating property, adhesion with adhesive in oil and phosphatability.

TABLE 14

| No. | Galvanized steel sheet | Silicate or silicic acid: Type | $SiO_2$ particle size (nm) | A value* (%) | $SiO_2$ content (g/liter) | Drying temperature (°C.) | Oil viscosity ($mm^2$/ at 40° C.) | Frictional coefficient | Adhesion: adhesive in oil T peel strength (kgf/25 mm) | Phosphatability |
|---|---|---|---|---|---|---|---|---|---|---|
| 1 | Galvannealed steel sheet | silicic acid | 20 | 0.15 | 16 | 100 | 40 | 0.11 | 11.0 | ○ |
| 2 | Galvannealed steel sheet | silicic acid | 50 | 0.15 | 16 | 100 | 40 | 0.11 | 11.2 | ○ |
| 3 | Galvannealed steel sheet | silicic acid | 100 | 0.15 | 16 | 100 | 40 | 0.11 | 11.3 | ○ |
| 4 | Galvannealed steel sheet | silicic acid | 200 | 0.15 | 16 | 100 | 40 | 0.11 | 11.4 | ○ |
| 5 | Galvannealed steel sheet | silicic acid | 300 | 0.15 | 16 | 100 | 40 | 0.11 | 11.5 | ○ |
| 6 | Galvannealed steel sheet | silicic acid | 30 | 0.01 | 16 | 100 | 40 | 0.11 | 11.7 | ○ |
| 7 | Galvannealed steel sheet | silicic acid | 30 | 0.03 | 16 | 100 | 40 | 0.11 | 11.7 | ○ |
| 8 | Galvannealed steel sheet | silicic acid | 30 | 0.05 | 16 | 100 | 40 | 0.11 | 11.6 | ○ |
| 9 | Galvannealed steel sheet | silicic acid | 30 | 0.10 | 16 | 100 | 40 | 0.11 | 11.5 | ○ |
| 10 | Galvannealed steel sheet | silicic acid | 30 | 0.30 | 16 | 100 | 40 | 0.11 | 11.5 | ○ |
| 11 | Galvannealed steel sheet | silicic acid | 30 | 0.50 | 16 | 100 | 40 | 0.11 | 11.5 | ○ |
| 12 | Galvannealed steel sheet | silicic acid | 30 | 0.70 | 16 | 100 | 40 | 0.11 | 11.4 | ○ |
| 13 | Galvannealed steel sheet | silicic acid | 30 | 1.00 | 16 | 100 | 40 | 0.11 | 11.2 | ○ |
| 14 | Galvannealed steel sheet | silicic acid | 30 | 2.00 | 16 | 100 | 40 | 0.11 | 11.1 | ○ |
| 15 | Galvannealed steel sheet | silicic acid | 30 | 3.00 | 16 | 100 | 40 | 0.11 | 11.0 | ○ |
| 16 | Galvannealed steel sheet | Na silicate | 30 | 0.15 | 16 | 100 | 40 | 0.11 | 11.5 | ○ |
| 17 | Galvannealed steel sheet | Na silicate | 30 | 0.50 | 16 | 100 | 40 | 0.11 | 11.4 | ○ |
| 18 | Galvannealed steel sheet | Na silicate | 30 | 2.00 | 16 | 100 | 40 | 0.11 | 11.0 | ○ |
| 19 | Galvannealed steel sheet | Li silicate | 30 | 0.15 | 16 | 100 | 40 | 0.11 | 11.5 | ○ |
| 20 | Galvannealed steel sheet | K silicate | 30 | 0.15 | 16 | 100 | 40 | 0.11 | 11.5 | ○ |

TABLE 14-continued

| No. | Galvanized steel sheet | Silicate or silicic acid: Type | $SiO_2$ particle size (nm) | A value* (%) | $SiO_2$ content (g/liter) | Drying temperature (°C.) | Oil: viscosity ($mm^2$/ at 40° C.) | Frictional coefficient | Adhesion: adhesive in oil T peel strength (kgf/25 mm) | Phosphatability |
|---|---|---|---|---|---|---|---|---|---|---|
| 21 | Galvannealed steel sheet | silicic acid | 30 | 0.15 | 0.1 | 100 | 1 | 0.13 | 11.8 | ○ |
| 22 | Galvannealed steel sheet | silicic acid | 30 | 0.15 | 0.5 | 100 | 5 | 0.12 | 11.7 | ○ |
| 23 | Galvannealed steel sheet | silicic acid | 30 | 0.15 | 1 | 100 | 10 | 0.11 | 11.7 | ○ |
| 24 | Galvannealed steel sheet | silicic acid | 30 | 0.15 | 5 | 100 | 20 | 0.11 | 11.5 | ○ |
| 25 | Galvannealed steel sheet | silicic acid | 30 | 0.15 | 10 | 100 | 40 | 0.11 | 11.5 | ○ |

*A value: weight ratio of $(Na_2O + Li_2O + K_2O)/SiO_2$

TABLE 15

| No. | Galvanized steel sheet | Silicate or silicic acid: Type | $SiO_2$ particle size (nm) | A value* (%) | $SiO_2$ content (g/liter) | Drying temperature (°C.) | Oil: viscosity ($mm^2$/ at 40° C.) | Frictional coefficient | Adhesion: adhesive in oil T peel strength (kgf/25 mm) | Phosphatability |
|---|---|---|---|---|---|---|---|---|---|---|
| 26 | Galvannealed steel sheet | silicic acid | 30 | 0.15 | 20 | 100 | 40 | 0.11 | 11.5 | ○ |
| 27 | Galvannealed steel sheet | silicic acid | 30 | 0.15 | 16 | 100 | 40 | 0.11 | 11.5 | ○ |
| 28 | Galvannealed steel sheet | silicic acid | 30 | 0.15 | 16 | 100 | 40 | 0.11 | 11.5 | ○ |
| 29 | Galvannealed steel sheet | silicic acid | 30 | 0.15 | 16 | 100 | 40 | 0.11 | 11.5 | ○ |
| 30 | Galvannealed steel sheet | silicic acid | 30 | 0.15 | 16 | 100 | 40 | 0.11 | 11.5 | ○ |
| 31 | Galvannealed steel sheet | silicic acid | 30 | 0.01 | 16 | 100 | 40 | 0.11 | 11.5 | ○ |
| 32 | Galvannealed steel sheet | silicic acid | 30 | 0.03 | 16 | 100 | 40 | 0.11 | 11.5 | ○ |
| 33 | Galvannealed steel sheet | silicic acid | 30 | 0.05 | 16 | 100 | 40 | 0.11 | 11.5 | ○ |
| 34 | Electrogalvanization | Li silicate | 30 | 0.10 | 16 | 100 | 40 | 0.13 | 11.5 | ○ |
| 35 | Electrogalvanization | K silicate | 30 | 0.30 | 16 | 100 | 40 | 0.13 | 11.5 | ○ |
| 36 | Electrogalvanization | Na silicate | 30 | 0.50 | 16 | 100 | 40 | 0.13 | 11.5 | ○ |
| 37 | Electrogalvanization | silicic acid | 30 | 0.70 | 16 | 100 | 40 | 0.13 | 11.5 | ○ |
| 38 | Hot-dip galvanization | Li silicate | 30 | 1.00 | 16 | 100 | 40 | 0.12 | 11.5 | ○ |
| 39 | Hot-dip galvanization | K silicate | 30 | 2.00 | 16 | 100 | 40 | 0.12 | 11.5 | ○ |
| 40 | Hot-dip galvanization | Na silicate | 30 | 3.00 | 16 | 100 | 40 | 0.12 | 11.5 | ○ |
| 41 | Hot-dip galvanization | silicic acid | 30 | 0.15 | 16 | 100 | 40 | 0.12 | 11.5 | ○ |
| 42 | Electrodeposition with Zn—Fe | silicic acid | 30 | 0.50 | 16 | 100 | 40 | 0.10 | 11.5 | ○ |
| 43 | Electrodeposition with Zn—Ni | silicic acid | 30 | 2.00 | 16 | 100 | 40 | 0.10 | 11.5 | ○ |
| 44 | Galvannealed steel sheet | silicic acid | 10 | 0.15 | 16 | 100 | 40 | 0.11 | 8.0 | x |
| 45 | Galvannealed steel sheet | silicic acid | 400 | 0.15 | 16 | 100 | 40 | 0.14 | 11.7 | ○ |
| 46 | Galvannealed steel sheet | silicic acid | 30 | 4.00 | 16 | 100 | 40 | 0.11 | 6.0 | x |
| 47 | Galvannealed steel sheet | silicic acid | 30 | 0.15 | 0.05 | 100 | 0.5 | 0.17 | 11.8 | ○ |
| 48 | Galvannealed steel sheet | silicic acid | 30 | 0.15 | 16 | 70 | 40 | 0.15 | 11.5 | ○ |
| 49 | Galvannealed steel sheet | — | — | — | — | — | — | 0.18 | 11.8 | ○ |

*A value: weight ratio of $(Na_2O + Li_2O + K_2O)/SiO_2$

EXAMPLE 9

In the present example, the effect of $SiO_2$ size and length on the lubricating property, adhesion with adhesive in oil and phosphatability were assessed.

Solutions containing given volumes of silicic acid ($SiO_2$ colloidal solution) of rod-like $SiO_2$ particles were coated on galvanized steel sheets, by means of a pinch roll. After coating, the sheets were dried to form hard $SiO_2$ coatings containing silicic acid or silicate. The concentration of silicic acid in the coating solution was 16 g/liter as corrected into $SiO_2$; the concentration of alkali components was 0.15% by weight; the $SiO_2$ deposition was 40 mg/$m^2$; and the drying temperature was 100° C.

The galvanized steel sheets were assessed of their lubricating property, adhesion with adhesive in oil and phosphatability. The results are collectively shown in Table 16, together with the production conditions. The examples (Nos. 50 to 59) satisfying all the requirements defined by the present invention are indicated to have excellent lubricating property, adhesion with adhesive in oil and phosphatability.

TABLE 16

| No. | Galvanized steel sheet | Silicate or silicic acid: Type | $SiO_2$ particle size (nm) | $SiO_2$ length (nm) | Frictional coefficient | Adhesion with adhesive in oil: T peel strength (kgf/25 mm) | Phosphatability |
|---|---|---|---|---|---|---|---|
| 50 | Galvannealed steel sheet | silicic acid | 1 | 100 | 0.11 | 11.5 | ○ |
| 51 | Galvannealed steel sheet | silicic acid | 5 | 100 | 0.10 | 11.5 | ○ |
| 52 | Galvannealed steel sheet | silicic acid | 10 | 100 | 0.11 | 11.5 | ○ |
| 53 | Galvannealed steel sheet | silicic acid | 30 | 100 | 0.11 | 11.5 | ○ |

TABLE 16-continued

| No. | Galvanized steel sheet | Silicate or silicic acid Type | $SiO_2$ particle size (nm) | $SiO_2$ length (nm) | Frictional coefficient | Adhesion with adhesive in oil T peel strength (kgf/25 mm) | Phosphatability |
|---|---|---|---|---|---|---|---|
| 54 | Galvannealed steel sheet | silicic acid | 50 | 100 | 0.13 | 11.5 | ○ |
| 55 | Galvannealed steel sheet | silicic acid | 30 | 20 | 0.11 | 11.5 | ○ |
| 56 | Galvannealed steel sheet | silicic acid | 30 | 50 | 0.12 | 11.5 | ○ |
| 57 | Galvannealed steel sheet | silicic acid | 30 | 100 | 0.11 | 11.5 | ○ |
| 58 | Galvannealed steel sheet | silicic acid | 30 | 200 | 0.11 | 11.5 | ○ |
| 59 | Galvannealed steel sheet | silicic acid | 30 | 300 | 0.10 | 11.5 | ○ |
| 60 | Galvannealed steel sheet | silicic acid | 0.1 | 10 | 0.12 | 6.3 | x |
| 61 | Galvannealed steel sheet | silicic acid | 0.2 | 10 | 0.11 | 5.6 | x |
| 62 | Galvannealed steel sheet | silicic acid | 0.5 | 10 | 0.12 | 7.4 | x |
| 63 | Galvannealed steel sheet | silicic acid | 0.5 | 5 | 0.11 | 6.5 | x |
| 64 | Galvannealed steel sheet | silicic acid | 0.5 | 15 | 0.11 | 6.4 | x |
| 65 | Galvannealed steel sheet | silicic acid | 70 | 400 | 0.20 | 11.3 | Δ |
| 66 | Galvannealed steel sheet | silicic acid | 100 | 500 | 0.19 | 10.6 | Δ |
| 67 | Galvannealed steel sheet | silicic acid | 150 | 600 | 0.18 | 11.4 | Δ |
| 68 | Galvannealed steel sheet | silicic acid | 100 | 600 | 0.19 | 10.8 | Δ |
| 69 | Galvannealed steel sheet | silicic acid | 100 | 600 | 0.21 | 11.2 | Δ |

Because the inventive steel sheet has the composition described above, the sheet has excellent lubricating property and phosphatability, and additionally, the sheet has improved adhesion with adhesive in oil. The production method of the present invention is very useful as a method for efficiently producing such lubricant film coated steel sheet. Because the method uses low-cost silicic acid (silicate), the method can decrease the production cost with improved productivity.

What is claimed is:

1. A lubricant film coated steel sheet having excellent phosphatability, produced by forming a coating containing silicic acid or silicate on a steel sheet or a plated steel sheet, having micro-fine recesses and protrusions on the surface thereof, wherein the surface roughness of the steel sheet or the plated steel sheet, prior to coating, is 0.5 to 1.5 $\mu$m as the centerline-average roughness RA and the total number of peaks of a size above 1.25 $\mu$m per 1-cm length PPI thereof is 75 to 300; and the content of silicic acid or silicate in the coating is 1 to 200 mg/m$^2$ as corrected into dried $SiO_2$ weight or the covered ratio of the coating is 1 to 60%.

2. A lubricant film coated steel sheet according to claim 1, wherein the silicate is at least one selected from $Na_2O{\cdot}nSiO_2$, $K_2O{\cdot}nSiO_2$, or $Li_2O{\cdot}nSiO_2$ ("n" is an integer of 3 or more).

3. A lubricant film coated steel sheet according to claim 1, containing a wax particle of dispersing type in water in the coating.

4. A lubricant film coated steel sheet according to claim 1, containing oxides of one or more elements selected from the group consisting of Zn, Ni, Co, Fe, P, B, Ca, Mo, W and V to a total sum of the weights of the elements at 1 to 100 mg/m$^2$ in the coating.

5. A lubricant film coated steel sheet according to claim 1, being coated with an oil at a viscosity of 5 to 50 mm$^2$/s at 40° C.

6. A lubricant film coated steel sheet according to any one of claims 1 to 5, wherein the plated steel sheet is a zinc or zinc alloy coated steel sheet.

7. A lubricant film coated steel sheet according to claim 6, wherein the plating of the zinc or zinc alloy coated steel sheet is the galvannealing at an Fe content of 7 to 15%.

8. A lubricant film coated steel sheet according to any one of claims 1 to 5, wherein the ratio B/A should be controlled not less than 1.2, provided that A and B are designated as the $SiO_2$ coating weight at the protrusion parts of the surface of the lubricant film coated steel sheet and the $SiO_2$ coating weight at the recess parts thereof, respectively, whereby the adhesion with adhesive in oil is improved.

9. A lubricant film coated steel sheet according to claim 2, wherein the total sum of $Na_2O$, $K_2O$, and $Li_2O$ contained in the coating is 3% by weight or less of the $SiO_2$ in the coating.

10. A lubricant film coated steel sheet according to claim 7, wherein the plated steel sheet is a zinc or zinc alloy coated steel sheet.

11. A lubricant film coated steel sheet according to claim 10, wherein the plating of the zinc or zinc alloy coated steel sheet is the galvannealing at an Fe content of 7 to 15%.

12. A method for producing a lubricant film coated steel sheet having excellent adhesion with adhesive in oil and fine phosphatability according to claim 1, comprising coating a liquid of a $SiO_2$ content of not less than 0.1 g/liter in water and a $(Na_2O+Li_2O+K_2O)/SiO_2$ weight ratio of 3% by weight or less (inclusive of 0%) on the surface of a steel sheet or a zinc or zinc alloy coated steel sheet prior to drying, thereby forming a coating containing silicic acid or silicate on the surface of the steel sheet or the zinc or zinc alloy coated steel sheet.

13. A method for producing a lubricant film coated steel sheet according to claim 12, wherein the drying temperature is 80° C. or more.

14. A method for producing a lubricant film coated steel sheet according to claim 12, wherein the $SiO_2$ in the solution is of a spherical particle of a particle size of 20 to 300 nm.

15. A method for producing a lubricant film coated steel sheet according to claim 12, wherein the $SiO_2$ in the solution is of a rod-like particle of a size (D) of 1 to 50 nm and a length (T) of 20 to 300 nm, provided that D<T.

16. A method for producing a lubricant film coated steel sheet according to claim 12, wherein the plated steel sheet is a zinc or zinc alloy coated steel sheet.

* * * * *